US011821272B2

(12) United States Patent
Ng et al.

(10) Patent No.: US 11,821,272 B2
(45) Date of Patent: Nov. 21, 2023

(54) DETECTING A MUD MOTOR STALL

(71) Applicant: PASON SYSTEMS CORP., Calgary (CA)

(72) Inventors: Choon-Sun James Ng, Calgary (CA); Sean William Scotvold, Calgary (CA); John Aaron Eddy, Calgary (CA)

(73) Assignee: PASON SYSTEMS CORP.

( * ) Notice: Subject to any disclaimer, the term of this patent is extended or adjusted under 35 U.S.C. 154(b) by 0 days.

(21) Appl. No.: 16/826,553

(22) Filed: Mar. 23, 2020

(65) Prior Publication Data

US 2021/0270097 A1 Sep. 2, 2021

(51) Int. Cl.

| | |
|---|---|
| ***E21B 21/08*** | (2006.01) |
| ***E21B 4/02*** | (2006.01) |
| ***E21B 44/04*** | (2006.01) |

(52) U.S. Cl.

CPC ..... *E21B 21/08* (2013.01); *E21B 4/02* (2013.01); *E21B 44/04* (2013.01)

(58) Field of Classification Search

CPC ..... E21B 21/08; E21B 4/02; E21B 44/04

See application file for complete search history.

(56) References Cited

U.S. PATENT DOCUMENTS

| | | | |
|---|---|---|---|
| 7,588,088 | B2 | 9/2009 | Kracik |
| 8,567,523 | B2 | 10/2013 | Stacy et al. |
| 9,194,183 | B2 | 11/2015 | Stacy et al. |
| 9,316,053 | B2 | 4/2016 | Stacy et al. |
| 9,995,128 | B2 | 6/2018 | Stacy et al. |
| 2018/0023382 | A1* | 1/2018 | Ringer ..... E21B 44/00 175/50 |
| 2019/0128078 | A1* | 5/2019 | Doyon ..... E21B 19/155 |
| 2019/0323335 | A1* | 10/2019 | Ocegueda-Hernandez ..... E21B 4/02 |

FOREIGN PATENT DOCUMENTS

| | | | |
|---|---|---|---|
| CA | 2636249 | B1 | 6/2011 |

OTHER PUBLICATIONS

Canadian Office Action dated May 14, 2020.

Sakoe et al., "Dynamic Programming Algorithm Optimization for Spoken Word Recognition," IEEE Transactions on Acoustics, Speech, and Signal Processing, vol. ASSP-26, No. 1, Feb. 1978, pp. 43-49.

Fu, "A review on time series data mining," Engineering Applications of Artificial Intelligence, vol. 24, 2011, pp. 164-181.

Lin, et al., "Experiencing SAX: a novel symbolic representation of time series," Data Mining and Knowledge Discovery, vol. 15, 2007, pp. 107-144.

Drilex International, "Best Practices for Downhole Motor Operations in Coiled Tubing Applications," available at <http://web.archive.org/web/20170502081856/http://www.drilexpower.com/Power-Sections/Best_Practices.pdf>, archived on May 2, 2017, pp. 1-6.

* cited by examiner

*Primary Examiner* — Dany E Akakpo

(74) *Attorney, Agent, or Firm* — KATTEN MUCHIN ROSENMAN LLP

(57) ABSTRACT

There is described an automated method of detecting a mud motor stall. During a drilling operation, a potential mud motor stall is determined to have occurred, based on drilling parameter data. In response thereto, potential mud motor stall data obtained from the drilling parameter data is compared to stored mud motor stall data associated with mud motor stalls. Based on the comparison, the potential mud motor stall may be confirmed or not confirmed as a mud motor stall.

14 Claims, 24 Drawing Sheets

| $\beta_i$ \ $\alpha$ | 3 | 4 | 5 | 6 | 7 | 8 | 9 | 10 |
|---|---|---|---|---|---|---|---|---|
| $\beta_1$ | -0.43 | -0.67 | -0.84 | -0.97 | -1.07 | -1.15 | -1.22 | -1.28 |
| $\beta_2$ | 0.43 | 0 | -0.25 | -0.43 | -0.57 | -0.67 | -0.76 | -0.84 |
| $\beta_3$ | | 0.67 | 0.25 | 0 | -0.18 | -0.32 | -0.43 | -0.52 |
| $\beta_4$ | | | 0.84 | 0.43 | 0.18 | 0 | -0.14 | -0.25 |
| $\beta_5$ | | | | 0.97 | 0.57 | 0.32 | 0.14 | 0 |
| $\beta_6$ | | | | | 1.07 | 0.67 | 0.43 | 0.25 |
| $\beta_7$ | | | | | | 1.15 | 0.76 | 0.52 |
| $\beta_8$ | | | | | | | 1.22 | 0.84 |
| $\beta_9$ | | | | | | | | 1.28 |

FIG. 14

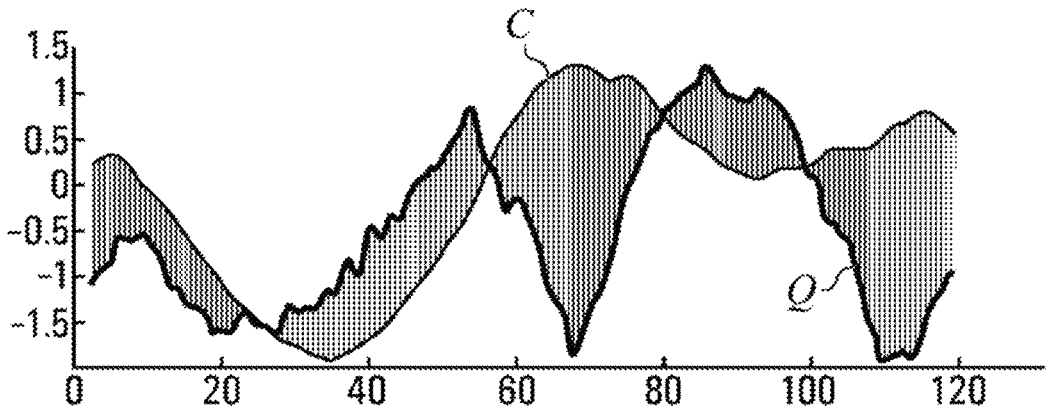
FIG. 15A
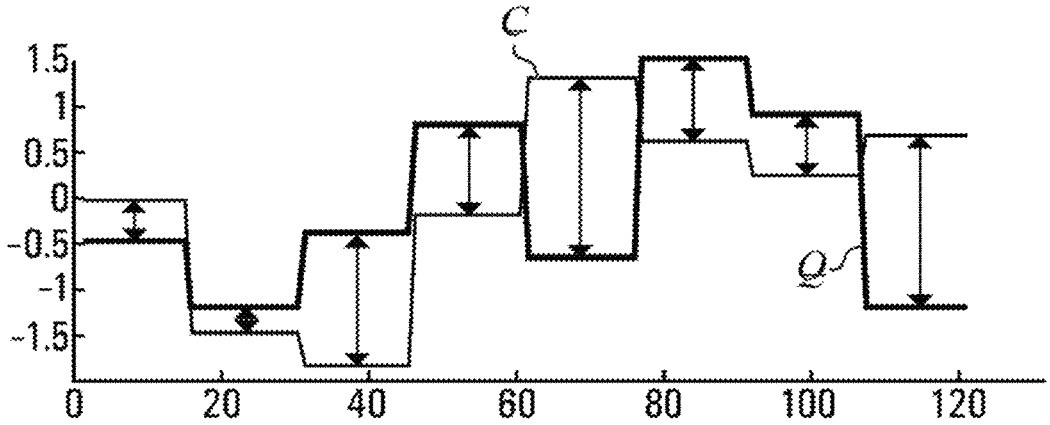
FIG. 15B
$\hat{C}$ = b a a b c c b c
$\hat{Q}$ = b a b c a c c a
FIG. 15C

DETECTING A MUD MOTOR STALL

FIELD OF THE DISCLOSURE

The present disclosure relates to methods, systems, and computer-readable media for detecting a mud motor stall.

BACKGROUND TO THE DISCLOSURE

Mud motors are devices that convert hydraulic power, generated by the circulation of drilling fluid from the surface and down through the drill pipe, to rotational power directly at the drill bit. As drilling mud is pumped down the drill pipe, it encounters the power section near the drill bit. In the power section, the drilling mud is forced through a progressive cavity displacement pump where the drilling fluid imparts torque on a rotor, thereby rotating the drill bit at the distal end of the rotor. Alternatively, turbine motors can be used in place of a progressive cavity displacement pump.

A mud motor is used to increase the bit rotational speed above what is achievable through rotation at the surface alone, in addition to whenever it is necessary to rotate the drill bit without rotating the drill string (as in during directional or slide drilling). The amount of rotational power developed at the drill bit depends on the torque and rotational speed developed by the mud motor.

A mud motor stall can occur when the drilling motor is not capable of providing enough torque to keep the drill bit rotating. Various combinations of factors, including excessive weight on bit, bit damage, and changes in lithology, can lead to mud motor stalls. When a stall occurs, the build-up of reactive torque can cause damage to the motor components and other downhole equipment. In cases where significant damage has occurred, motor seals may fail which may lead to the loss of hydraulic power. In some cases, the entire downhole assembly must be brought to the surface for repair or replacement.

Motor stalls can occur without warning as isolated events, in rapid succession, or intermittently throughout the drilling of an entire wellbore. Furthermore, the severity of a stall event, and the resulting impact on the drilling process, may be unpredictable.

Mud motors may also experience minor stalls ("microstalls") that generally are stalls that do not develop into full-blown, major stalls. Microstalls have a shorter duration than full stalls, may generate a maximum pressure spike that is less than that of a full stall, and have the potential to develop into full motor stalls. Microstalls may be more difficult to detect than full motor stalls, and multiple microstalls can slowly degrade the mud motor over time.

Generally, detecting the potential onset of a mud motor stall relies on the past experience of the driller. As a result, current methods of detecting and preventing mud motor stalls are fairly unreliable.

There therefore remains a need in the art for improved methods and systems for detecting mud motor stalls.

SUMMARY OF THE DISCLOSURE

According to a first aspect of the disclosure, there is provided a method of detecting a mud motor stall, comprising: obtaining drilling parameter data; using one or more stall detectors to perform a first stall detection operation comprising: determining, based on the drilling parameter data, that a potential mud motor stall has occurred; and using the one or more stall detectors to perform a second stall detection operation comprising: in response to determining that the potential mud motor stall has occurred, comparing potential mud motor stall data to stored mud motor stall data associated with one or more mud motor stalls, wherein the potential mud motor stall data is based on the drilling parameter data; and based on the comparison, determining whether the potential mud motor stall is a mud motor stall.

Obtaining the drilling parameter data may comprise: measuring one or more drilling parameters; and generating the drilling parameter data from the measured one or more drilling parameters.

Determining that the potential mud motor stall has occurred may comprise: determining, based on the drilling parameter data, a rate of change of one or more drilling parameters; comparing the rate of change of the one or more drilling parameters to a threshold rate of change; and based on the comparison of the rate of change of the one or more drilling parameters to the threshold rate of change, determining that the potential mud motor stall has occurred.

Generating the drilling parameter data may comprise processing measurements of the one or more drilling parameters. Determining that the potential mud motor stall has occurred may be further based on the processed measurements of the one or more drilling parameters.

Performing the second stall detection operation may further comprise, before comparing the potential mud motor stall data to the stored mud motor stall data, generating the potential mud motor stall data using the drilling parameter data.

Generating the potential mud motor stall data may comprise: filtering processed measurements of one or more drilling parameters by: identifying change points in the processed measurements; and eliminating the processed measurements lying outside of a range defined by the change points; and using the filtered processed measurements to generate the potential mud motor stall data. For example, generating the potential mud motor stall data may comprise filtering processed measurements of one or more drilling parameters by identifying change points in the processed measurements, and using only the filtered processed measurements (i.e. only the processed measurements lying between the change points) to generate the potential mud motor stall data.

Generating the potential mud motor stall data may comprise generating, using the drilling parameter data, one or more signatures of the potential mud motor stall.

Generating the one or more signatures of the potential mud motor stall may comprise applying piecewise aggregate approximation analysis to the drilling parameter data.

Comparing the potential mud motor stall data to the stored mud motor stall data may comprise comparing the one or more signatures of the potential mud motor stall to one or more stored signatures of the one or more mud motor stalls, wherein the one or more stored signatures are generated from the stored mud motor stall data.

Comparing the one or more signatures of the potential mud motor stall to the one or more stored signatures of the one or more mud motor stalls may comprise using dynamic time warping analysis to determine one or more distances between the one or more signatures of the potential mud motor stall and the one or more stored signatures of the one or more mud motor stalls.

Comparing the one or more signatures of the potential mud motor stall to the one or more stored signatures of the one or more mud motor stalls may comprise using symbolic aggregate approximation analysis to determine one or more distances between the one or more signatures of the potential mud motor stall and the one or more stored signatures of the one or more mud motor stalls.

The one or more stored signatures may comprise multiple stored signatures, and the method may further comprise: grouping the multiple stored signatures into one or more groups of stored signatures, according to one or more similarities between the multiple stored signatures, wherein comparing the one or more signatures of the potential mud motor stall to the one or more stored signatures may comprise comparing the one or more signatures of the potential mud motor stall to each group of stored signatures.

The one or more drilling parameters may comprise one or more of: weight on bit; differential pressure; standpipe pressure; pump pressure; rotary torque; bit torque; rotary revolutions per minute; bit revolutions per minute; mechanical specific energy; and rate of penetration.

The method may further comprise, prior to performing the first stall detection operation: generating one or more signatures of the one or more mud motor stalls using drilling parameter data generated from drilling parameter measurements obtained during the one or more mud motor stalls; and storing the one or more signatures in a database.

The method may further comprise, if the potential mud motor stall is determined to be a mud motor stall, further storing in the database one or more signatures of the potential mud motor stall.

The one or more mud motor stalls associated with the stored mud motor stall data may be one or more historic mud motor stalls.

The method may further comprise, if the potential mud motor stall is determined to be a mud motor stall, adjusting one or more drilling parameter setpoints associated with one or more drilling parameters.

The method may further comprise, before adjusting the one or more drilling parameter setpoints, determining a severity of the mud motor stall based on one or more of: one or more of minimum and maximum values of one or more drilling parameters during the mud motor stall; a rate of change of one or more drilling parameters during the mud motor stall; and an amount by which one or more operational thresholds of a mud motor were exceeded during the mud motor stall, wherein the adjusting may be based on the determined severity of the mud motor stall.

The method may further comprise generating a notification or initiating an alarm in response to one or more of: determining that the potential mud motor stall has occurred; and determining that the potential mud motor stall is a mud motor stall.

According to a further aspect of the disclosure, there is provided a system for detecting a mud motor stall, comprising: one or more stall detectors comprising one or more processors configured to receive as inputs measurements of one or more drilling parameters, wherein the one or more stall detectors are configured to: perform a first stall detection operation comprising: generating drilling parameter data from the measurements of the one or more drilling parameters; and determining, based on the drilling parameter data, that a potential mud motor stall has occurred; perform a second stall detection operation comprising: in response to determining that the potential mud motor stall has occurred, comparing potential mud motor stall data to stored mud motor stall data associated with one or more mud motor stalls, wherein the potential mud motor stall data is based on the drilling parameter data; and based on the comparison, determining whether the potential mud motor stall is a mud motor stall.

The method performed by the one or more stall detectors may comprise any of the features described above in connection with the first aspect of the disclosure.

According to a further aspect of the disclosure, there is provided a computer-readable medium having stored thereon computer program code configured when executed by one or more processors to cause the one or more processors to perform a method comprising: performing a first stall detection operation comprising: obtaining drilling parameter data; determining, based on the drilling parameter data, that a potential mud motor stall has occurred; and performing a second stall detection operation comprising: in response to determining that the potential mud motor stall has occurred, comparing potential mud motor stall data to stored mud motor stall data associated with one or more mud motor stalls, wherein the potential mud motor stall data is based on the drilling parameter data; and based on the comparison, determining whether the potential mud motor stall is a mud motor stall.

The method performed by the one or more processors may comprise any of the features described above in connection with the first aspect of the disclosure.

According to a further aspect of the disclosure, there is provided a drilling rig comprising: a drill string having a mud motor at an end of the drill string; sensors for measuring drilling parameters; and one or more stall detectors comprising one or more processors configured to receive as inputs measurements of the one or more drillings parameters obtained by the sensors, and configured to: perform a first stall detection operation comprising: generating drilling parameter data from the measurements of the one or more drilling parameters; determining, based on the drilling parameter data, that a potential mud motor stall has occurred at the mud motor; and perform a second stall detection operation comprising: in response to determining that the potential mud motor stall has occurred, generating potential mud motor stall data based on the drilling parameter data; generating one or more signatures of the potential mud motor stall, based on the potential mud motor stall data; comparing the one or more signatures of the potential mud motor stall to one or more stored signatures of one or more mud motor stalls; and based on the comparison, determining whether the potential mud motor stall is a mud motor stall.

The method performed by the one or more stall detectors may comprise any of the features described above in connection with the first aspect of the disclosure.

BRIEF DESCRIPTION OF THE DRAWINGS

Embodiments of the disclosure will now be described in detail in conjunction with the accompanying drawings of which:

FIG. 14 shows a look-up table, according to embodiments of the disclosure;

FIGS. 15A-C show (A) a Euclidean distance, (B) a SAX distance, and (C) a distance between symbols calculated using equation (25), according to embodiments of the disclosure;

DETAILED DESCRIPTION

Figure 1:
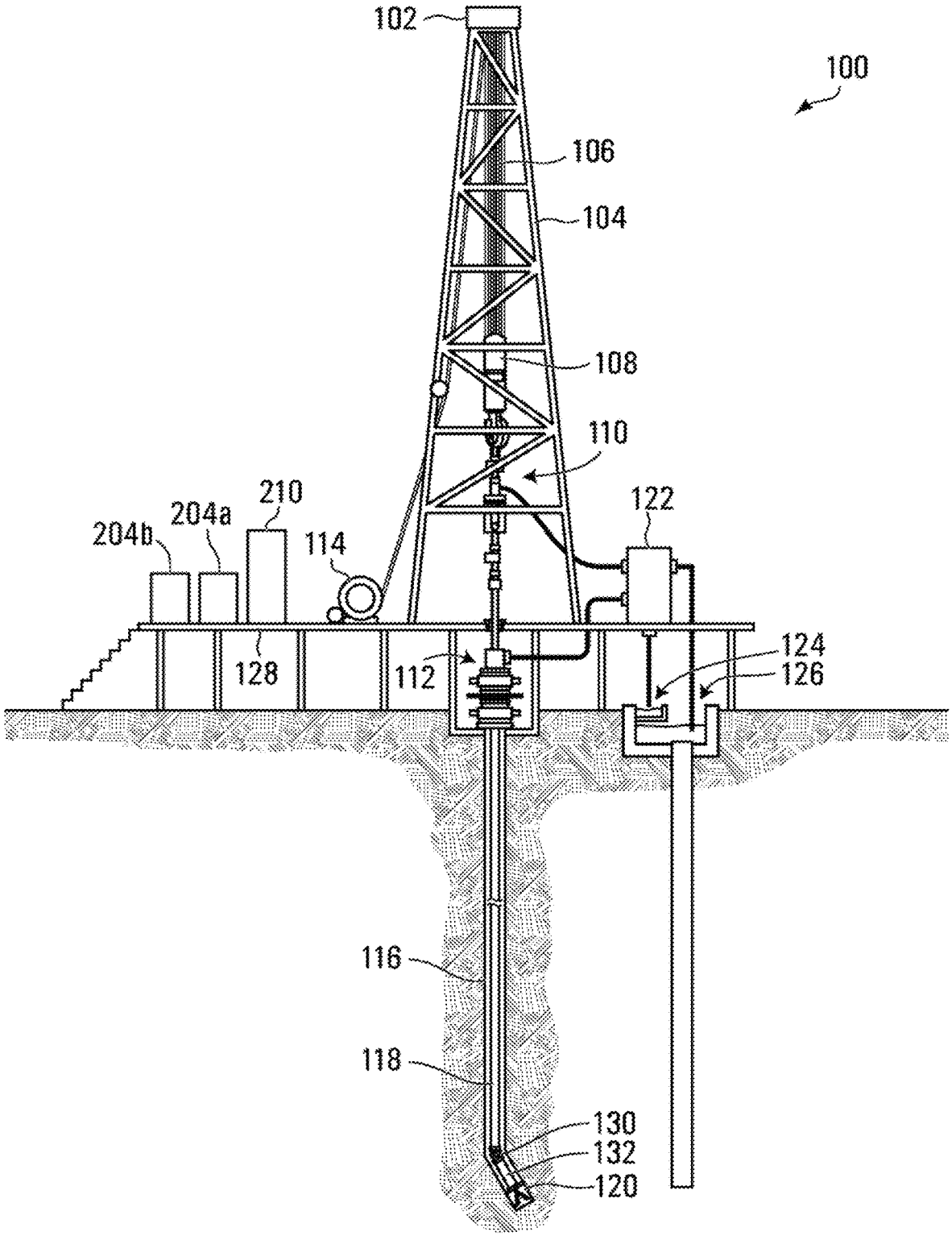
FIG. 1 is a schematic of a drilling rig, according to embodiments of the disclosure.

The present disclosure seeks to provide methods, systems, and computer-readable media for detecting a mud motor stall. While various embodiments of the disclosure are described below, the disclosure is not limited to these embodiments, and variations of these embodiments may fall within the scope of the disclosure which is to be limited only by the appended claims.

The word "a" or "an" when used in conjunction with the term "comprising" or "including" in the claims and/or the specification may mean "one", but it is also consistent with the meaning of "one or more", "at least one", and "one or more than one" unless the content clearly dictates otherwise. Similarly, the word "another" may mean at least a second or more unless the content clearly dictates otherwise.

The terms "coupled", "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through one or more intermediate elements or devices via an electrical element, electrical signal or a mechanical element depending on the particular context. The term "and/or" herein when used in association with a list of items means any one or more of the items comprising that list.

As used herein, a reference to "about" or "approximately" a number or to being "substantially" equal to a number means being within +/−10% of that number.

Abnormal changes to sets of drilling parameters measured at the surface can sometimes indicate the onset of a mud motor stall. For example, sudden increases followed by decreases in pump pressure, standpipe pressure, rotary torque, or weight on bit, together with abnormal fluctuations in the rate of penetration of the drill bit, may be each or in combination indicative of a mud motor stalling.

If a mud motor has stalled, the drilling process may sometimes continue normally without any human intervention. In other cases, changes to drilling parameter setpoints must be made in order to resume normal operation. In severe cases, a return to drilling may not be at all possible due to critical damage to components of the mud motor. Finally, if a mud motor stall has occurred, appropriate procedures should be followed to mitigate the risk of potentially damaging effects. The course of action may be dependent, for example, on the severity of the stall, the frequency of stall events, and/or the number of successive stall events that are detected.

Generally, embodiments of the disclosure are aimed at identifying early warning signs of a mud motor stall, by analyzing real-time changes in measured drilling parameters. Frequently, a major stall leading to a failure of the mud motor is precipitated by several smaller stalls (e.g. microstalls) that may be more difficult in practice to detect and/or identify. The cumulative damage to the mud motor caused by multiple microstalls may lead to eventual failure of the mud motor. Generally, embodiments of the disclosure are aimed at detecting such microstalls (e.g. potential mud motor stalls) as well as microstalls that have developed into full mud motor stalls.

Embodiments of the disclosure are further directed at detecting and validating a stall occurrence by recognizing one or more patterns in the stall event that are consistent with those of stall events in measured drilling parameters. Personnel may be alerted to the onset and occurrence of a mud motor stall, the severity of the stall may be assessed, and one or more drilling parameter setpoints may be adjusted in response to the stall.

Generally, according to embodiments of the disclosure, herein are described methods and systems for the improved detection of mud motor stalls during a drilling operation. During the drilling operation, a stall detector is used to perform a first stall detection operation. During the first stall detection operation, a potential mud motor stall is identified. The potential mud motor stall may be a microstall (e.g. an event having one or more characteristics that may develop into characteristics indicative of a mud motor stall). The potential mud motor stall may be identified, for example, by monitoring drilling parameters and determining when a rate of change of one or more of the drilling parameters exceeds an upper limit, or drops below a lower limit.

In response to detecting a potential mud motor stall, the stall detector is then used to perform a second stall detection operation during which the potential mud motor stall is either confirmed as relating to an actual mud motor stall (e.g. a microstall developed into a full mud motor stall), or discarded as relating to some other non-stall event. In response to determining that the potential mud motor stall has occurred, the stall detector compares data obtained during first stall detection operation, and in connection with the potential mud motor stall, to stored data. For example, the stall detector may generate a signature of the potential mud motor stall and compare the signature to a set of stored signatures. The stored signatures may relate to signatures of historic or otherwise actual mud motor stalls. Based on the comparison, a determination may be made as to whether or not the potential mud motor stall is a mud motor stall. In response to confirming that the potential mud motor stall is a mud motor stall, an alert may be issued, and metrics of the mud motor stall may be collected. The metrics may be used, for example, to control future adjustment of drilling parameter setpoints, to mitigate against further mud motor stalls occurring.

Turning to FIG. 1, there is shown a drilling rig 100 according to an embodiment of the disclosure. The rig 100 comprises a derrick 104 that supports a drill string 118. The drill string 118 has a drill bit 120 at its downhole end, which is used to drill a wellbore 116. A drawworks 114 is located on the drilling rig's 100 floor 128. A drill line 106 extends from the drawworks 114 to a traveling block 108 via a crown block 102. The traveling block 108 is connected to the drill string 118 via a top drive 110. Rotating the drawworks 114 consequently is able to change weight on bit (WOB) during drilling, with rotation in one direction lifting the traveling block 108 and generally reducing WOB and rotation in the opposite direction lowering the traveling block 108 and generally increasing WOB. The drill string 118 also comprises, near the drill bit 120, a bent sub 130 and a mud motor 132. The mud motor's 132 rotation is powered by the flow of drilling mud through the drill string 118, as discussed in further detail below, and combined with the bent sub 130 permits the rig 100 to perform directional drilling. The top drive 110 and mud motor 132 collectively provide rotational force to the drill bit 120 that is used to rotate the drill bit 120 and drill the wellbore 116. While in FIG. 1 the top drive 110 is shown as an example rotational drive unit, in a different embodiment (not depicted) another rotational drive unit may be used, such as a rotary table.

A mud pump 122 rests on the floor 128 and is fluidly coupled to a shale shaker 124 and to a mud tank 126. The mud pump 122 pumps mud from the mud tank 126 into the drill string 118 at or near the top drive 110, and mud that has circulated through the drill string 118 and the wellbore 116 return to the surface via a blowout preventer ("BOP") 112. The returned mud is routed to the shale shaker 124 for filtering and is subsequently returned to the tank 126.

Figure 2:
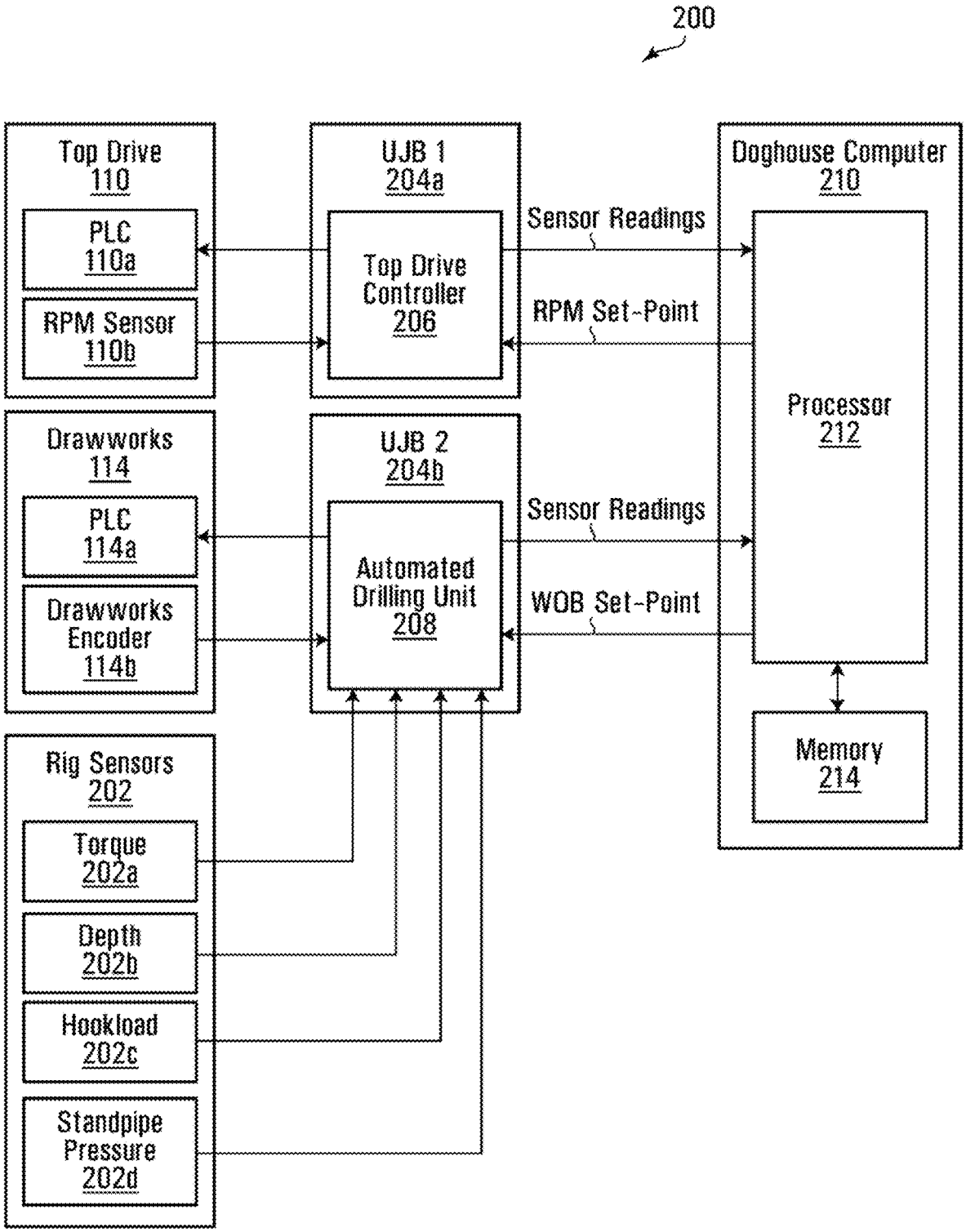
FIG. 2 is a block diagram of a system for performing automated drilling of a wellbore, according to embodiments of the disclosure.

FIG. 2 shows a block diagram of a system 200 for performing automated drilling of a wellbore, according to the embodiment of FIG. 1. The system 200 comprises various rig sensors: a torque sensor 202*a*, a depth sensor 202*b*, a hookload sensor 202*c*, and a standpipe pressure sensor 202*d* (collectively, "sensors 202").

The system 200 also comprises the drawworks 114 and top drive 110. The drawworks 114 comprises a programmable logic controller ("drawworks PLC") 114*a* that controls the drawworks' 114 rotation and a drawworks encoder 114*b* that outputs a value corresponding to the current height of the traveling block 108. The top drive 110 comprises a top drive programmable logic controller ("top drive PLC") 110*a* that controls the top drive's 114 rotation and an RPM sensor 110*b* that outputs the rotational rate of the drill string 118. More generally, the top drive PLC 110*a* is an example of a rotational drive unit controller and the RPM sensor 110*b* is an example of a rotation rate sensor.

A first junction box 204*a* houses a top drive controller 206 which is communicatively coupled to the top drive PLC 110*a* and the RPM sensor 110*b*. The top drive controller 206 controls the rotation rate of the drill string 118 by instructing the top drive PLC 110*a* and obtains the rotation rate of the drill string 118 from the RPM sensor 110*b*.

A second junction box 204*b* houses an automated drilling unit 208 (e.g., an automatic driller), which is communicatively coupled to the drawworks PLC 114*a* and the drawworks encoder 114*b*. The automated drilling unit 208 modulates WOB during drilling by instructing the drawworks PLC 114*a*, and obtains the height of the traveling block 108 from the drawworks encoder 114*b*. In different embodiments, the height of the traveling block 108 can be obtained digitally from rig instrumentation, such as directly from the PLC 114*a* in digital form. In different embodiments (not depicted), the junction boxes 204*a*,204*b* may be combined in a single junction box, comprise part of the doghouse computer 210, or be connected indirectly to the doghouse computer 210 by an additional desktop or laptop computer.

The automated drilling unit 208 is also communicatively coupled to each of the sensors 202. In particular, the automated drilling unit 208 determines WOB from the hookload sensor 202*c* and determines the rate of penetration (ROP) of the drill bit 120 by monitoring the height of the traveling block 108 over time.

The system 200 also comprises a doghouse computer 210. The doghouse computer 210 comprises a processor 212 and memory 214 communicatively coupled to each other. The memory 214 stores on it computer program code that is executable by the processor 212 and that, when executed, causes the processor 212 to perform automated drilling of the wellbore 116 by providing inputs to top drive controller 206 and automated drilling unit 208. The processor 212 receives readings from the RPM sensor 110*b*, drawworks encoder 114*b*, and the rig sensors 202, and sends an RPM target and a WOB target to the top drive controller 206 and automated drilling unit 208, respectively. The top drive controller 206 and automated drilling unit 208 relay these targets to the top drive PLC 110*a* and drawworks PLC 114*a*, respectively, where they are used for automated drilling. More generally, the RPM target is an example of a rotation rate target.

Figure 4:
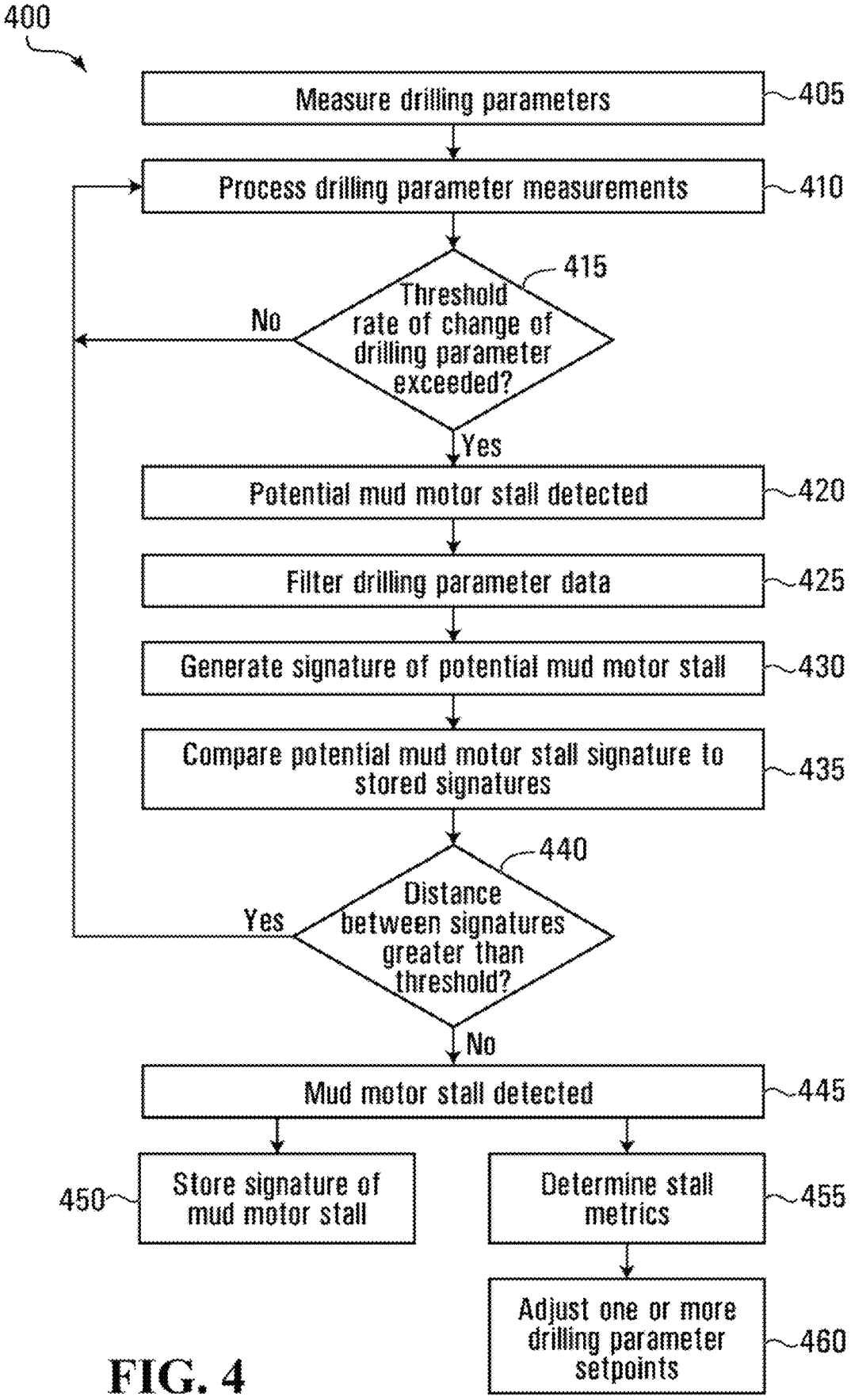
FIG. 4 is a flow diagram of a method for detecting mud motor stalls, according to embodiments of the disclosure.

The memory 214 further stores computer program code that is executable by the processor 212 and that, when executed, causes the processor 212 to perform a method for detecting mud motor stalls, such as that depicted in FIG. 4.

Each of the first and second junction boxes may comprise a Pason Universal Junction Box™ (UJB) manufactured by Pason Systems Corp. of Calgary, Alberta. The automated drilling unit 208 may be a Pason Autodriller™ manufactured by Pason Systems Corp. of Calgary, Alberta.

The top drive controller 110, automated drilling unit 208, and doghouse computer 210 collectively comprise an example type of drilling controller. In different embodiments, however, the drilling controller may comprise different components connected in different configurations. For example, in the system 200 of FIG. 2, the top drive controller 110 and the automated drilling unit 208 are distinct and respectively use the RPM target and WOB target for automated drilling. However, in different embodiments (not depicted), the functionality of the top drive controller 206 and automated drilling unit 208 may be combined or may be divided between three or more controllers. In certain embodiments (not depicted), the processor 212 may directly communicate with any one or more of the top drive 110, drawworks 114, and sensors 202. Additionally or alternatively, in different embodiments (not depicted) automated drilling may be done in response to only the RPM target, only the WOB target, one or both of the RPM and WOB targets in combination with additional drilling parameters, or targets based on drilling parameters other than RPM and WOB. Examples of these additional drilling parameters comprise differential pressure, an ROP target, depth of cut, torque, mechanical specific energy (MSE), and flow rate (into the wellbore 116, out of the wellbore 116, or both).

In the depicted embodiments, the top drive controller 110 and the automated drilling unit 208 acquire data from the sensors 202 discretely in time at a sampling frequency $F_s$, and this is also the rate at which the doghouse computer 210 acquires the sampled data. Accordingly, for a given period T, N samples are acquired with $N=TF_s$. In different embodiments (not depicted), the doghouse computer 210 may receive the data at a different rate than that at which it is sampled from the sensors 202. Additionally or alternatively, the top drive controller 110 and the automated drilling unit 208 may sample data at different rates, and more generally in embodiments in which different equipment is used data may be sampled from different sensors 202 at different rates.

Figure 3:
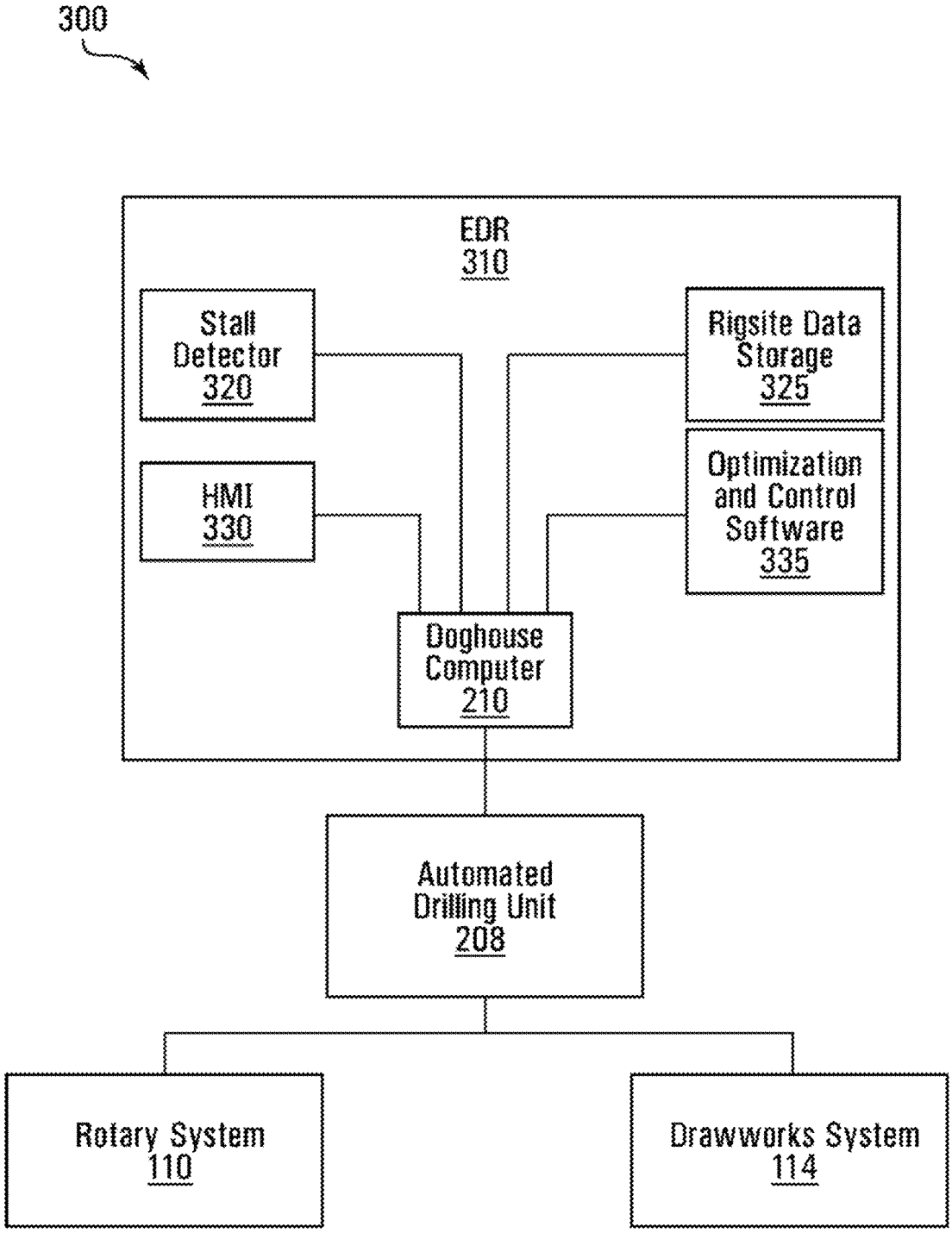
FIG. 3 is a block diagram of a system for detecting mud motor stalls, according to embodiments of the disclosure.

Turning to FIG. 3, there is shown a block diagram of a system 300 for performing automated detection of mud motor stalls. System 300 includes an electronic drilling recorder (EDR) 310 comprising a stall detector 320, Human Machine Interface (HMI) 330, rigsite data storage 325, optimization and control software 335, and doghouse computer 210. Doghouse computer 210 collects sensor readings from UJB 204*b* (FIG. 2). The sensor readings (which may be referred to as drilling parameters) include RPM, WOB, differential pressure, and torque. Other drilling parameters may be derived from RPM, WOB, differential pressure, and torque. For example, bit torque may be derived from differential pressure times the ratio of a maximum torque of the mud motor to a maximum differential pressure of the mud motor. Doghouse computer 210 processes the sensor readings into a stream of sensor data, and stall detector 320 is configured to receive the sensor data from doghouse computer 210. Based on the sensor data, stall detector 320 may detect the occurrence of a potential mud motor stall, and may validate the potential mud motor stall as an actual mud motor stall.

During the stall detection process, stall detector 320 may generate one or more alerts. For example, stall detector 320 may generate an alert in response to identifying a potential mud motor stall, and may generate a further alert in response to confirming the potential mud motor stall as a mud motor stall. Such alerts may be sent to HMI 330 which may be embodied on a rig display, doghouse computer 210, a workstation, or on a mobile/remote device. HMI 330 displays the alerts to an operator who may choose to act upon them.

In certain cases, stall detector 320 may adjust one or more drilling parameter setpoints (such as the ROP setpoint and the WOB setpoint). Adjusted drilling parameter setpoints are communicated to doghouse computer 210 and are sent from doghouse computer 210 to automated drilling unit 208. The setpoints may be updated in response to detecting a mud motor stall, in order to mitigate future mud motor stall occurrences, as described in further detail below. Automated drilling unit 208 may then control the drilling operation based on the updated drilling parameter setpoints, by controlling a rotary system (e.g., top drive 110) and a drawworks system (e.g., drawworks 114).

Turning to FIG. 4, there is shown a flow diagram illustrating a method of detecting a mud motor stall during a drilling operation, according to embodiments of the disclosure. The method illustrated in FIG. 4 describes an example embodiment using system 300, and further example embodiments of this method are described in greater detail in connection with FIGS. 5-22.

At block 405, stall detector 320 measures a number of drilling parameters. For example, stall detector 320 receives sensor data from doghouse computer 210 that obtained readings of drilling parameters from rig sensors 202. Based on the readings of the drilling parameters obtained at doghouse computer 210, stall detector 320 may measure one or more of: weight on bit (WOB); differential pressure (DIFFP); standpipe pressure (SPP); pump pressure; rotary torque; bit torque; rotary revolutions per minute (RPM); bit revolutions per minute; and rate of penetration (ROP). Certain drilling parameters may be derived from the readings of other drilling parameters.

At block 410, stall detector 320 processes the drilling parameter measurements obtained at block 405. For example, stall detector 320 processes the drilling parameter measurements to filter noise and to deal with non-stationarity of the signals. The processed drilling parameter measurements may be referred to as drilling parameter data.

At block 415, stall detector 320 determines whether a rate of change of any of processed drilling parameters has exceeded an upper limit or dropped below a lower limit, by comparing the rate of change to a threshold rate of change. If the rate of change of any of the processed drilling parameters exceeded an upper limit or dropped below a lower limit, then, at block 420, stall detector 320 determines that a potential mud motor stall has occurred. If the rate of change of any of the processed drilling parameters has not exceeded an upper limit or dropped below a lower limit, then the process returns to block 410.

At block 425, stall detector 320 filters the drilling parameter data. For example, stall detector 320 may determine change points, such as inflection points, of the drilling parameter data during the potential mud motor stall, and eliminate drilling parameter data that lies outside of a range defined by the change points.

At block 430, stall detector 320 generates a signature of the potential mud motor stall. For example, stall detector 320 may apply piecewise aggregate approximation (PAA) to the filtered drilling parameter data, to standardize, normalize, and transform the filtered drilling parameter data.

At block 435, stall detector 320 compares the signature of the potential mud motor stall to stored signatures of mud motor stalls. The stored signatures may be signatures of historic (i.e. real) or virtual mud motor stalls. The stored signatures may be generated based on drilling parameter data associated with the mud motor stalls. The comparison may be performed using any one of various suitable techniques. For example, according to some embodiments, dynamic time warping (DTW) or symbolic aggregate approximation (SAX) may be used to determine a distance between the signature of the potential mud motor stall and the stored signatures. At block 440, stall detector 320 determines, based on the comparison, whether the distance is greater than a threshold distance.

If the distance is greater than the threshold distance, then stall detector 320 determines that the potential mud motor stall is not a mud motor stall, in which case the process returns to block 410. If on the other hand the distance is less than the threshold distance, then stall detector 320 determines that the potential mud motor stall is a mud motor stall (block 445).

If stall detector 320 determines that the potential mud motor stall is a mud motor stall, then stall detector 320 may trigger one or more alarms to alert a user (not shown in shown in FIG. 4). In addition, at block 450, stall detector 320 may store the signature of the mud motor stall in the library of stored signatures. Therefore, future mud motor stalls that are similar to the just-detected mud motor stall are more likely to be detected as mud motor stalls.

At block 455, stall detector 320 determines stall metrics (such, for example, a severity of the stall). The severity of the stall may be based, for example, on maximum/minimum readings of drilling parameters during the mud motor stall. Stall detector 320 may furthermore initiate remedial action in view of the severity of the stall. For example, stall detector 320 may adjust one or more drilling parameter setpoints based on the severity of the stall (not shown in FIG. 4).

Further example embodiments of detecting a mud motor stall will now be described in conjunction with FIGS. 5-22.

Figure 5:
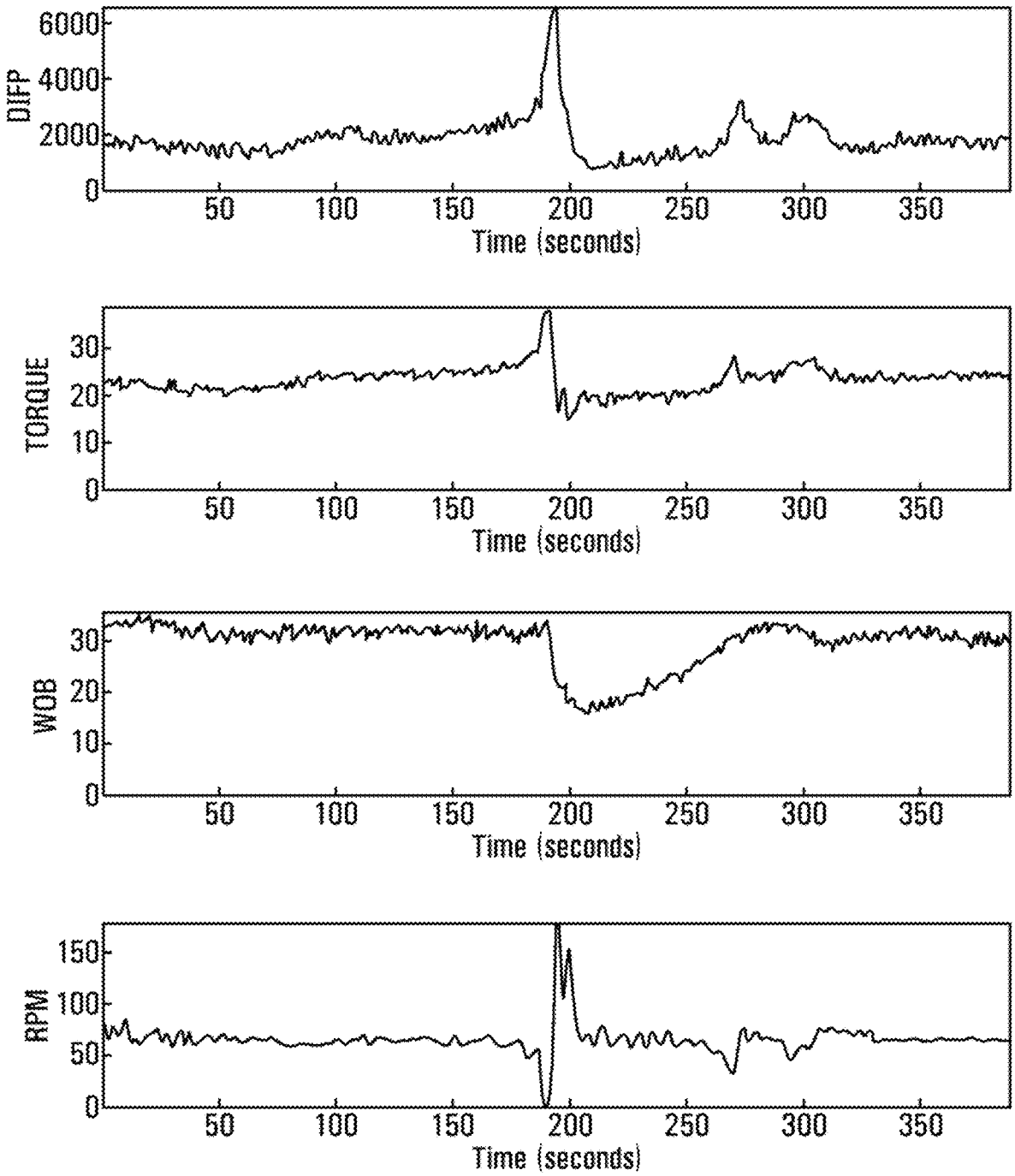
FIG. 5 shows plots of stall events for different drilling parameters, according to embodiments of the disclosure.
Figure 6:
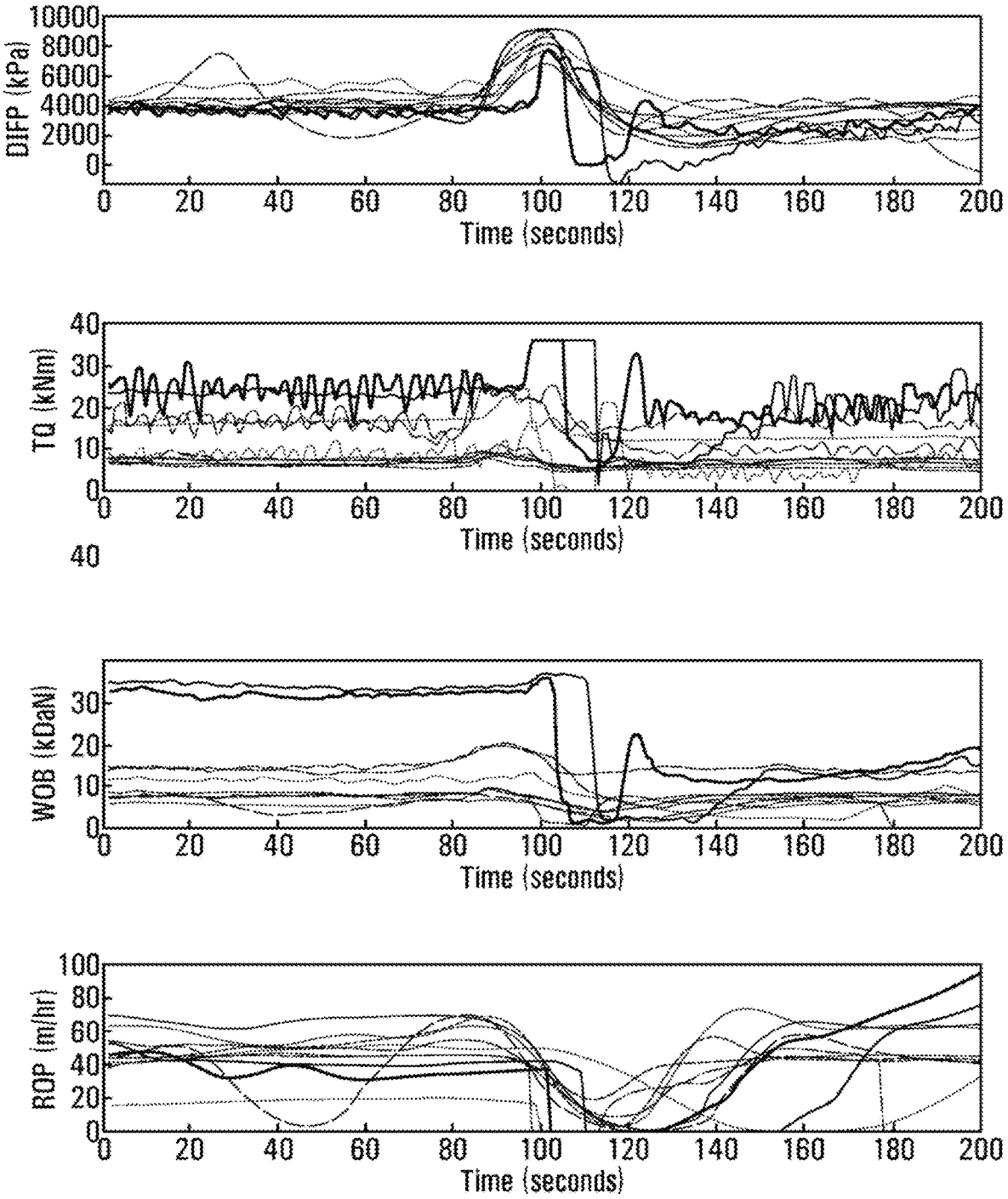
FIG. 6 shows plots of stall events for different drilling parameters and for various depths, wells, rigs, and equipment, according to embodiments of the disclosure.

An example of a stall occurrence is depicted in FIG. 5. The stall event shown in FIG. 5 is indicated by large, sharp increases in differential pressure, torque (such as surface, bit torque, or convertible torque), and WOB, followed by decreases in each drilling parameter. An inverse pattern is present in the RPM signature. In this example, each drilling parameter returns to nominal levels after the stall event. The multivariate set of time series of drilling parameters associated with a stall event may vary within a single well, and also across drilling rigs, equipment, and well locations. For example, individual traces in each set of drilling parameters shown in FIG. 6 differ in shape, magnitude, and duration.

According to embodiments of the disclosure, several steps may be used to provide a generalized way of identifying, validating, and classifying mud motor stalls with significantly different characteristics.

Event Detection

The stall detection process is triggered by an event detection procedure in which time series data of a set of drilling parameters is automatically processed in real-time. This event detection procedure may be referred to as a first stall detection operation.

During the first stall detection operation, the streaming data is analyzed for significant changes from nominal levels. Such significant deviations may indicate the onset of a stall event.

The raw, original readings of drilling parameters may suffer from non-stationarity and noise.

One way to deal with non-stationarity is by differencing the signal such that the differenced signal is given by:

$$x_t' = x_t - x_{t-1} \tag{1}$$

Differencing removes drift and centers the signal around zero. For each drilling parameter, the sampling rate should be sufficiently high in order to capture the shape of a stall event. In practice, a sampling rate of at least 1 Hz is used.

A trade-off in using differencing is the amplification of process and sensor noise at higher sampling rates. Filtering and smoothing techniques may therefore be used to reduce the noise. One approach is to average the signal over a time window of length L. Let $x_t$ be a value of a drilling parameter at time t and $\hat{x}_t$ be the weighted moving average of the differenced signal such that:

$$\hat{x}_t = \sum_{k=1}^{L} w_k x'_{t-k}$$

where $w_k$ is an assigned weight associated to each $x'_{t-k}$. The weights can be independently adjusted to change the relative importance to particular values of $x'_{t-k}$ with the constraint:

$$\sum_{k=1}^{L} w_k = 1$$

Figure 7A:
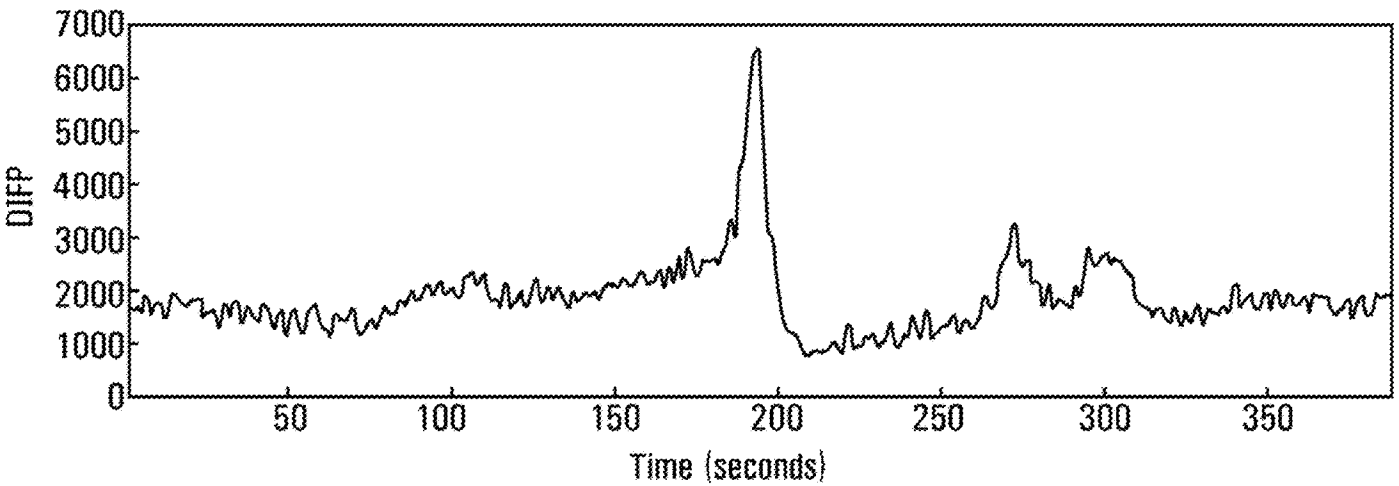
FIG. 7A is a plot of differential pressure as a function of time, according to embodiments of the disclosure.
Figure 7B:
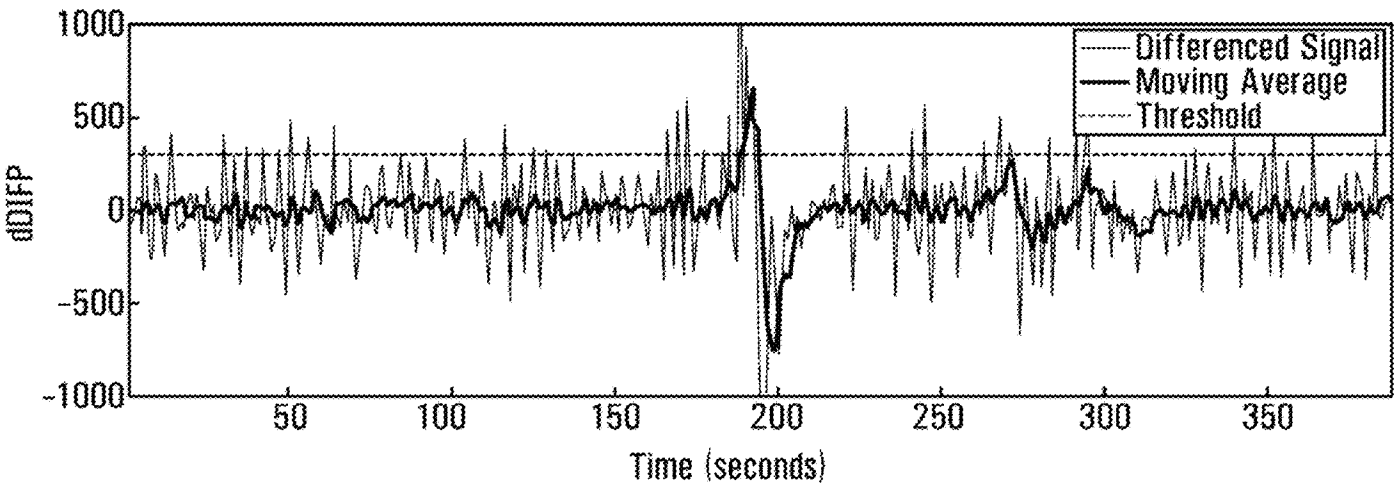
FIG. 7B is a plot of the differenced and averaged differential pressure of FIG. 7A, according to embodiments of the disclosure.

Examples of an original signal and the differenced and averaged signal are shown in FIGS. 7A and 7B with linear weights:

$$w_k = \frac{L-k+1}{\sum_{k=1}^{L} k}$$

A set of fixed thresholds $C_p$ can then be chosen for each drilling parameter to trigger the detection of a stall event. In other words, a stall event is detected if:

$$\hat{x}_{p,t} > C_p \tag{5}$$

where $\hat{x}_{p,t}$ indicates the differenced and averaged signal for drilling parameter p. An example of the differencing, averaging, and use of a threshold to detect a rate of change in a drilling parameter is shown in FIG. 7B. In FIGS. 7A and 7B, the original drilling parameter $x_t$ is shown in FIG. 7A, and the differenced and averaged sign $\hat{x}_t$ is shown in FIG. 7B with a window length L=5 seconds and uniformly weighted. The threshold is set to an average rate of change in differential pressure of 300 kPa/s. In this case, the initial event in equation (5) is detected at the 189 second mark. A second detection per equation (6) (see below) occurs at the 199 second mark.

After the initial detection of the stall event (which may be referred to as a "potential mud motor stall"), a second detection method is used to calculate scaling coefficients for a scaling and normalization process (described in further detail below). The second detection method identifies the inflection points in the differenced and averaged time series data where $$\{\hat{x}_{p,t} > \hat{x}_{p,t-1}\} \wedge \{\hat{x}_{p,t} < 0\} \tag{6}$$

for at least one drilling parameter p. The time between the conditions in equations (5) and (6) is calculated and is used in the following scaling and normalization process.

Scaling, Normalization, and Transformation

The scaling, normalization, and transformation process occurs during what may be referred to as a second stall detection operation. The goal of the second stall detection operation is to determine whether the potential mud motor stall detected during the first stall detection operation is in fact a mud motor stall.

Scaling and normalization are applied to standardize the signal length and magnitude for subsequent pattern matching routines. The time between the initial detection in equation (5) and the subsequent detection in equation (6) provides a discretization interval that sufficiently captures the shape of the patterns in each of the drilling parameters. A robust method that may be used for standardizing the signal is piecewise aggregate approximation (PAA), and provides a low-dimensional representation of the signal. The procedure for a single drilling parameter is described below.

The time between the initial detection in equation (5) and the subsequent detection in equation (6) is determined:

$$\hat{t}=\lceil \alpha(t_b-t_a) \rceil \tag{7}$$

where $\alpha>0$ is a configurable parameter used to scale the reference time interval window.

A subsequence of the parameter time series data is then generated, having a length $$n=\omega\hat{t} \tag{8}$$

where $\omega\in N$ is a configurable parameter to adjust the length of the subsequence. A subsequence y(t) of x(t) from time $t=t_b-n$ to time $t_b$ is obtained as:

$$y(t)=\{x(t_b-n),x(t_b-n+1), \ldots ,x(t_b)\}=\{x(t)\}_{t=t_b-n}^{t=t_b} \tag{9}$$

The subsequence y(t) is then normalized using the standard normal transform:

$$z(t)=\frac{y(t)-\mu}{\sigma}$$

where $\mu$ denotes the mean and a the standard deviation of the subsequence y(t).

The normalized subsequence z(t) of length n can be represented in an $\omega$-dimensional space by a vector of real numbers:

$$g(k)=\frac{\omega}{n}\sum_{j=\frac{n}{\omega}(k-1)+1}^{\frac{n}{\omega}k} z(j)$$

The values of the sequence g(k) for $k=1, \ldots , \omega$ are the averages of z(t) over the intervals of t with length $\hat{t}=n/\omega$ from equation (8).

Figure 8:
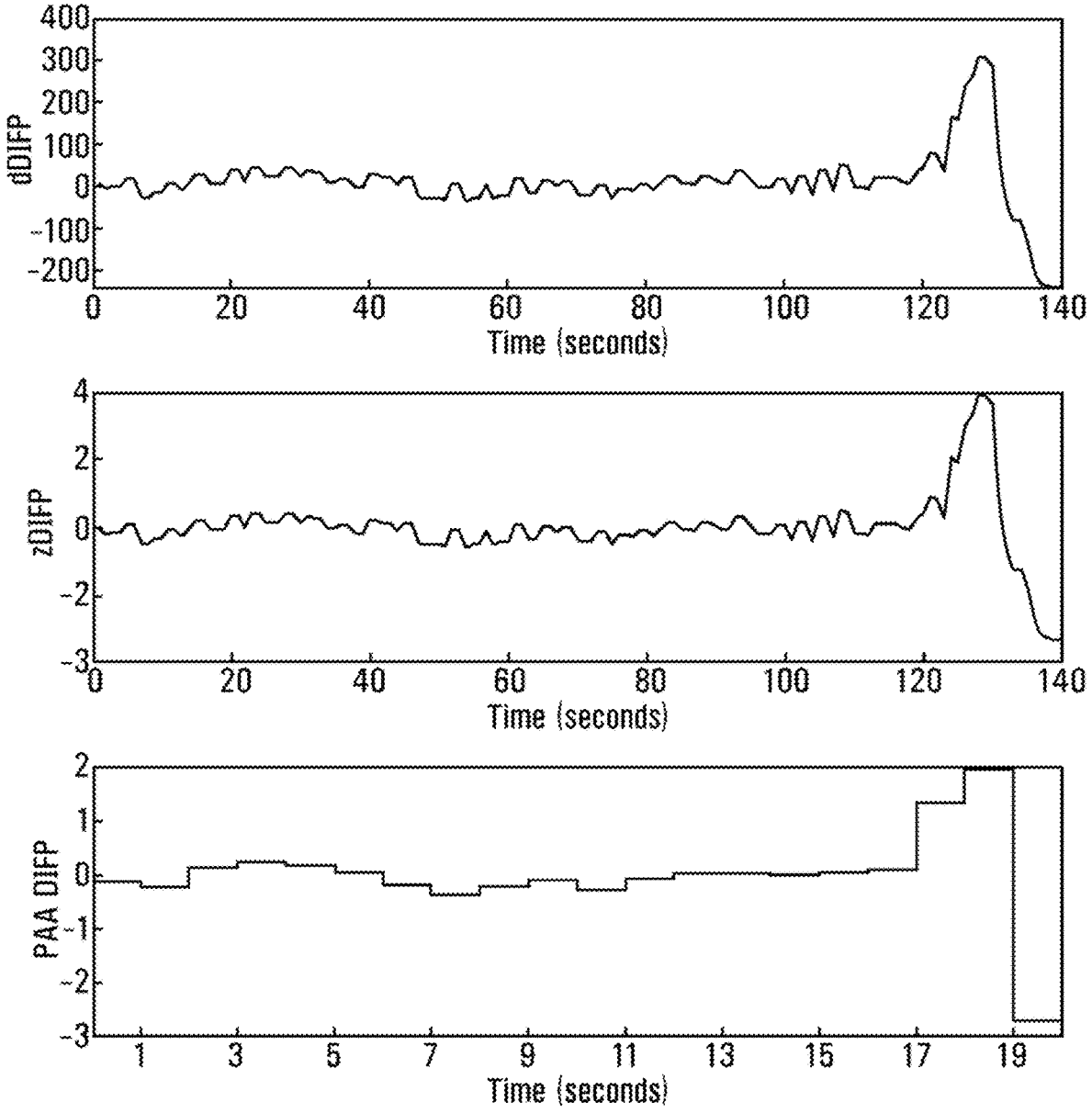
FIG. 8 shows a Piecewise Aggregate Approximation (PAA) of a z-transformation of the differenced and averaged differential pressure of FIG. 7A, according to embodiments of the disclosure.

The discretized series $g_{p,k}$ are the piecewise aggregate approximations of the differenced and averaged signal $\hat{x}_{p,t}$ for each drilling parameter p. For example, where $\hat{x}_t$ is as shown in FIG. 7B, the procedure is illustrated in FIG. 8 which shows the PAA representation with $\hat{t}=14$, $\alpha=2$, $\omega=20$, and n=140.

Pattern Recognition

The event detection and subsequent PAA representation described above enable the use of robust methods of times series pattern recognition of stall events. In order to confirm a potential mud motor stall as an actual mud motor stall, the PAA representation of a set of drilling parameters is attempted to be matched to a corresponding set of archetype representations or patterns that are extracted from historical drilling data. While any suitable method of matching the signature of the potential mud motor stall with stored signatures of actual mud motor stalls may be used, two particular methods are described in more detail below. These are dynamic time warping (DTW) and symbolic aggregate approximation (SAX).

As described below, it will now be determined whether patterns of potential mud motor stalls obtained from the real-time drilling process sufficiently match known patterns consistent with mud motor stalls.

The pattern, or "signature", of a potential mud motor stall is recognized as corresponding to the signature of an actual mud motor stall when the scaled, normalized, and transformed representation of a set of drilling parameters $\{g_p\}_{p=1}^{N_p}$ satisfies:

$$D(g,g^*)<\lambda^* \tag{12}$$

where D is the distance measure between $g_p$ and an archetype pattern g*, and $\lambda^*$ is an archetype distance.

A set of archetype patterns in drilling parameters can be obtained from historical drilling data. The steps of training and validating the historical drilling data are as follows:

1. Obtain a representative set of n examples for each of the $N_p$ number of drilling parameter time series corresponding to stall events, $\{x_{p,t}\}_{i=1}^{n}$ where $p=1, \ldots , N_p$.
2. Divide the data set into training and validation data sets containing $n_T$ and $n_V$ examples, respectively.
3. For each series in the training data set, perform the scaling, normalization, and transformation procedure described above, $\{g_{p,k}^{(i)}\}_{i=1}^{n_T}$.
4. For each drilling parameter set, calculate the distance D(•,•) between each of the representations. For example:

$$D(g_{p,k}^{(i)},g_{p,k}^{(j)}), \text{ for } i,j=1, \ldots ,n_T \tag{13}$$

5. Determine the archetype pattern and archetype distance for each drilling parameter:

(b) The archetype distance $D^*_{p,k}$ (•,•) for each $p=1, \ldots , Np$ is the distance which satisfies $$D(g_{p,k}^{(i)},g_{p,k}^{(j)}<\Delta_p \forall i,j=1, \ldots ,n,i\neq j \tag{14}$$

(c) (b) An archetype pattern $g^*_{p,k}$ for each parameter p is a $g_{p,k}$ that satisfies equation (14). This is the pattern, or set of patterns, that is the most similar to all others.

(d) Verify whether the threshold distances are satisfied.

In this case, a potential mud motor stall is verified as a mud motor stall if the patterns obtained from the event detection and PAA representation process described above, for example in FIG. 8, match the archetype pattern. An example of this procedure is provided in the below section "Example Training and Validation".

In some cases, the patterns in drilling parameters consistent with mud motor stall can vary significantly such that the use of a single set of archetype patterns and distances may not be sufficient to differentiate a potential mud motor stall from other types of events or operations in the drilling process. For example, mud motor stall events can appear as several different sets of patterns in the drilling parameter data, and therefore may correspond to multiple different archetypes. Furthermore, mud motor stall patterns can appear in subsets of the drilling parameter data or in combinations of each of drilling parameters in the drilling parameter data, including in the case of appearing in several different sets of patterns as discussed above.

Accordingly, one approach for improving the accuracy of the stall event detection methods described herein is to use multiple archetype patterns and distances. Thus, a library of reference patterns or archetypes may be created. If a potential mud motor stall is detected, its associated patterns, for example as represented in FIG. 8, are compared to multiple entries in the library. That is:

$$g_p\in\{S_p\}_{r=1}^{N_c} \text{if } D(g_p,g_p^{(r)})<\Delta^{(r)} \tag{15}$$

where $g^{(r)}_p$ is the archetype pattern, and $\lambda^{(r)}$ is the archetype distance for the parameter in a clustering group r=1, . . . , $N_c$, and $N_c$ is the number of clusters. In order to build the library, clustering methods may be added to the training and validation procedures.

For example, for each drilling parameter set, the distance D(•,•) between each of the representations is calculated. For instance, $$D(g_{p,k}^{(i)}, g_{p,k}^{(j)}, \text{ for } i,j=1, \ldots, n_T \quad (16)$$

(a) For each p=1, . . . , $N_p$, cluster the parameters $\{g_{p,k}^{(i)}\}_{i=1}^{n_T}$ in r=1, . . . , R groups by the distances D in equation (16).

(b) For each group, determine the archetype pattern and archetype distance per step 5, above.

In this case, a potential mud motor stall is verified as a mud motor stall if the patterns obtained from the event detection and PAA representation process described above, for example in FIG. 8, match at least one of the archetype patterns obtained through the clustering procedure.

Updating of Stall Pattern Archetypes

If a potential mud motor stall has been verified as a mud motor stall, the pattern or signature of the mud motor stall may be added as an additional reference pattern to the existing archetype pattern or archetype pattern library. One reason for doing this is that consecutive stall patterns may appear more similar to each other. Thus, if another stall occurs, that stall's pattern is compared to the augmented archetype pattern set, and a stall is recognized if:

$$D(g_p, g_p^*) < \lambda_p^*, \text{ where } g_p^* \in S_p^* \cup S_p^{**} \text{ and } \lambda_p^* \in \Lambda_p^* \cup \Lambda_p^{**} \quad (17)$$

where $S^*_p$ is the set of original archetype patterns, and $S^{**}_p$ is the set of new archetype patterns for each parameter p. Similarly, $\Lambda^*_p$ is the set of original archetype distances, and $\Lambda^{**}_p$ is the set of new archetype distances. Adding the previous stall patterns to the archetype pattern or archetype pattern library may improve the accuracy of the detection procedure.

Comparing Pattern Similarity and Calculating Distances

As noted previously, the detection of a mud motor stall relies on comparing the patterns in p parameters to corresponding archetype patterns. The similarity of the patterns is determined by calculating a measure of distance between each parameter to its respective archetype pattern. The patterns are considered similar if the calculated distance is less than an archetype distance. As described above, two particular methods are described in more detail below.

Dynamic Time Warping (DTW)

DTW, for example as described in *Dynamic Programming Algorithm Optimization for Spoken Word Recognition*, by Sakoe et al, IEEE Transactions on Acoustics, Speech, and Signal Processing, Vol. ASSP-26, No. 1, February 2978 (incorporated by reference in its entirety), is a class of algorithm that may be used for measuring the distance between two signals, and for sequence alignment (including time series and other ordered data).

In the case of two sequences P and Q:

$$P=p_1, p_2, \ldots, p_i, \ldots p_I \quad (18)$$

$$Q=q_1, q_2, \ldots, q_j, \ldots, q_J \quad (19)$$

Figure 9:
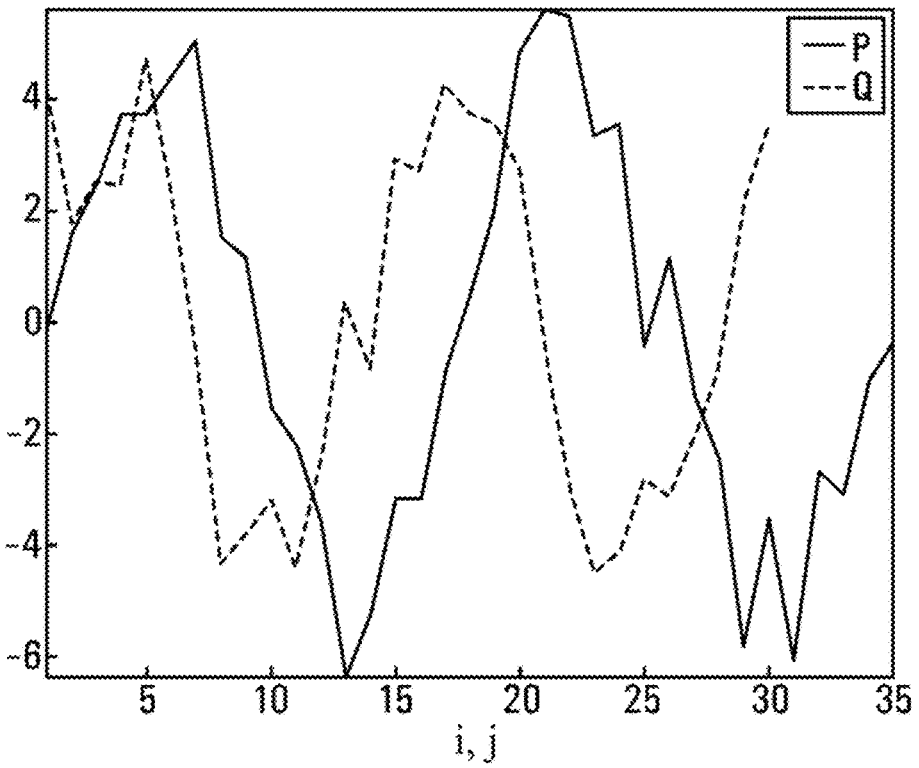
FIG. 9 shows two series P and Q, according to embodiments of the disclosure.
Figure 10:
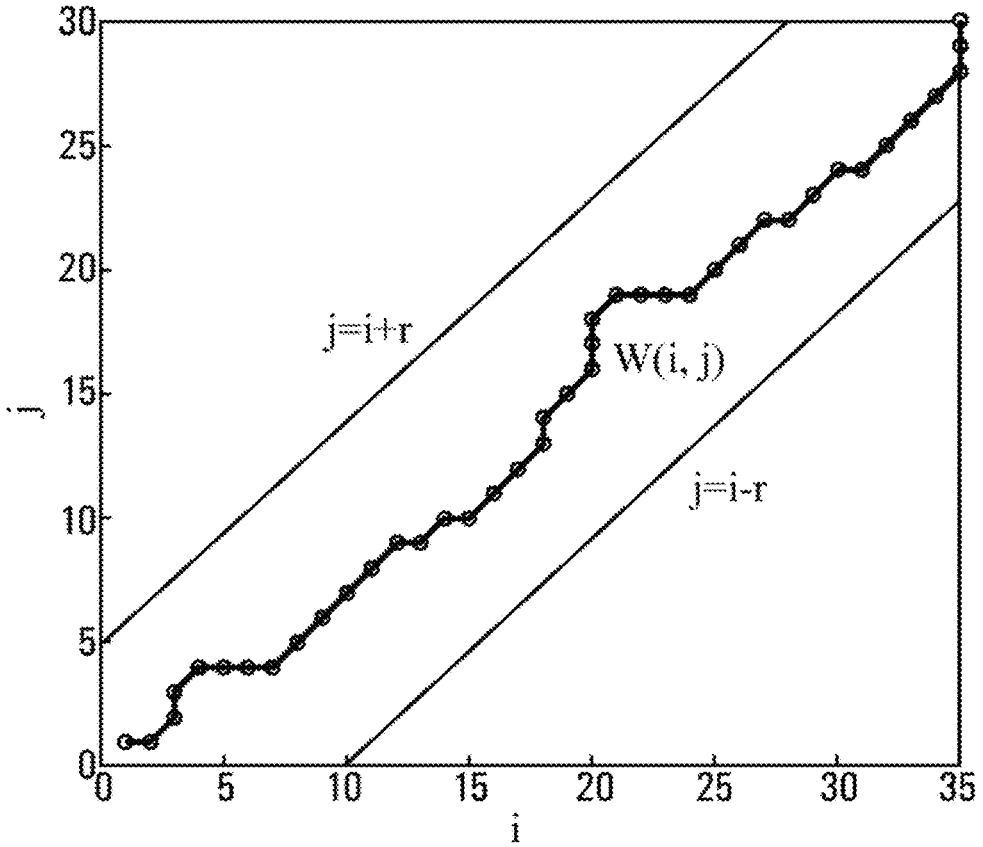
FIG. 10 shows a warping function for the series P and Q in FIG. 9, according to embodiments of the disclosure.

DTW aims to map one sequence onto the other. An example of series P and Q is depicted in FIG. 9. If, for example, (i,j) represent indices of time, the timing differences between the two series P and Q can be depicted by a sequence of points W(k) where $$S=W(1), \ldots, W(k), \ldots, W(K) \quad (20)$$

is a sequence representing a function that maps a series P onto a series Q in terms of time. The function W(k) is called a warping function which deviates from the diagonal line i=j as the difference between the two series grows. For P and Q as shown in FIG. 9, the warping path is depicted in FIG. 10 for P(i) with i=1, . . . , I, and Q(j) with j=1, . . . , J.

$$D(P, Q) = \min_{\lambda}$$

The difference between P and Q can be quantified as a distance:

$$d(W)=\|p_i-q_j\| \quad (22)$$

The weighted summation of the distances on the warping function W is given by:

$$J(W) = \sum_{k=1}^{K} d(W(k)) \cdot w(k)$$

where w(k)>=0 is a weighting coefficient that allows for tuning the warping function W. The function J reaches its minimum when W minimizes the distance between the patterns P and Q. Given two series, for example in FIG. 9, the normalized distance between $p_i$ and $q_j$ can be calculated as:

$$D(P, Q) = \min_{W} \frac{\sum_{k=1}^{K} d(W(k)) \cdot w(k)}{\sum_{k=1}^{K} w(k)}$$

The warping function may be bounded by a maximum deviation. In FIG. 10, the warping path is monotonically bounded with j∈[i−r, i+r]. Other bounding methods can be applied without loss of generality.

Figure 11:
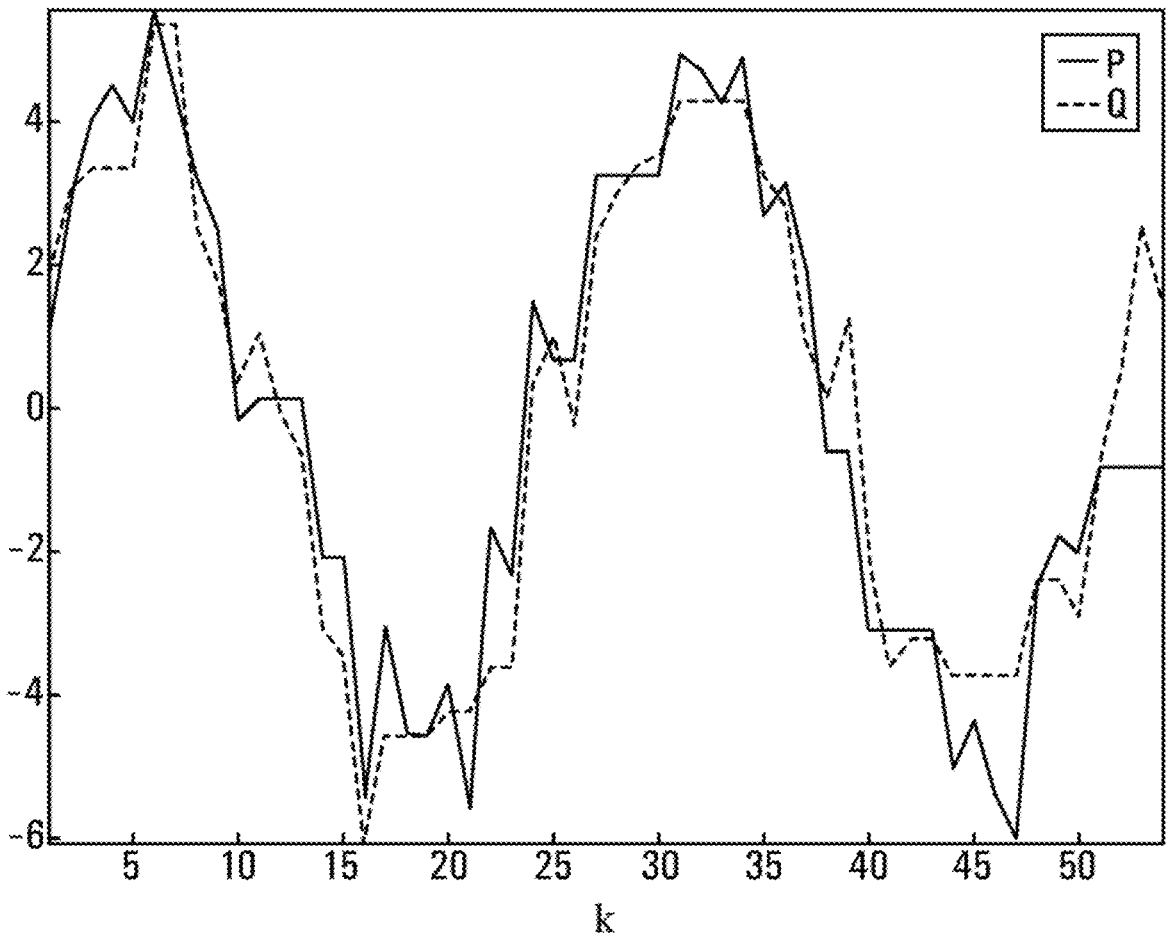
FIG. 11 shows an alignment of the series P and Q in FIG. 9, according to embodiments of the disclosure.

The alignment of the signals in FIG. 9 is shown in FIG. 11. In FIG. 11, P and Q are aligned with D(P,Q)=44.36.

Symbolic Aggregate Approximation (SAX)

SAX, for example as described in *Experiencing SAX: a novel symbolic representation of time series*, by LIN, Jessica, et al., Springer Science+Business Media, LLC, 2007 (incorporated by reference in its entirety), is an efficient similarity search technique used for sequence matching and pattern detection providing a balance between accuracy, flexibility, robustness, and low computational complexity. Using SAX, the PAA data sequence is first converted into a string of symbols (e.g. letters) with word length ω consisting of letters from an alphabet with cardinality γ∈N. The symbol (letter) s(k)∈Γ assigned to each data point of p(k) is determined according to its value relative to a set of breakpoints $b=(b_1, \ldots, b_{\gamma-1})$. The breakpoints provide approximate equiprobability of letters within a word if they are assigned to correspond to areas under a Gaussian curve (with mean 0 and standard deviation 1) such that the area from $b_i$ to $b_{i+1}$ is 1/ω, and $b_0=-\infty$ and $b_\omega=\infty$.

Figure 12A:
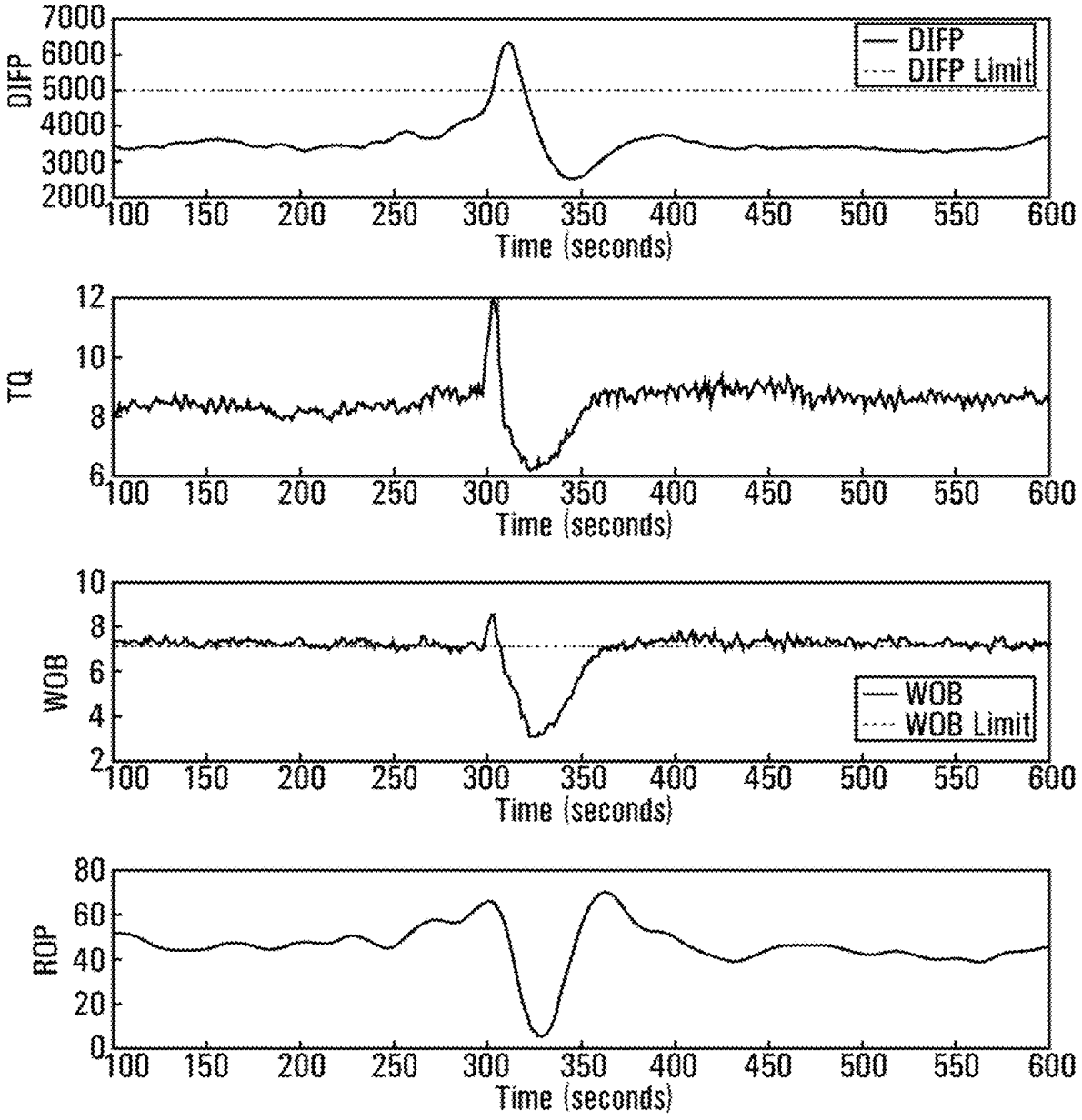
FIG. 12A shows plots of stall events for different drilling parameters, according to embodiments of the disclosure.
Figure 12B:
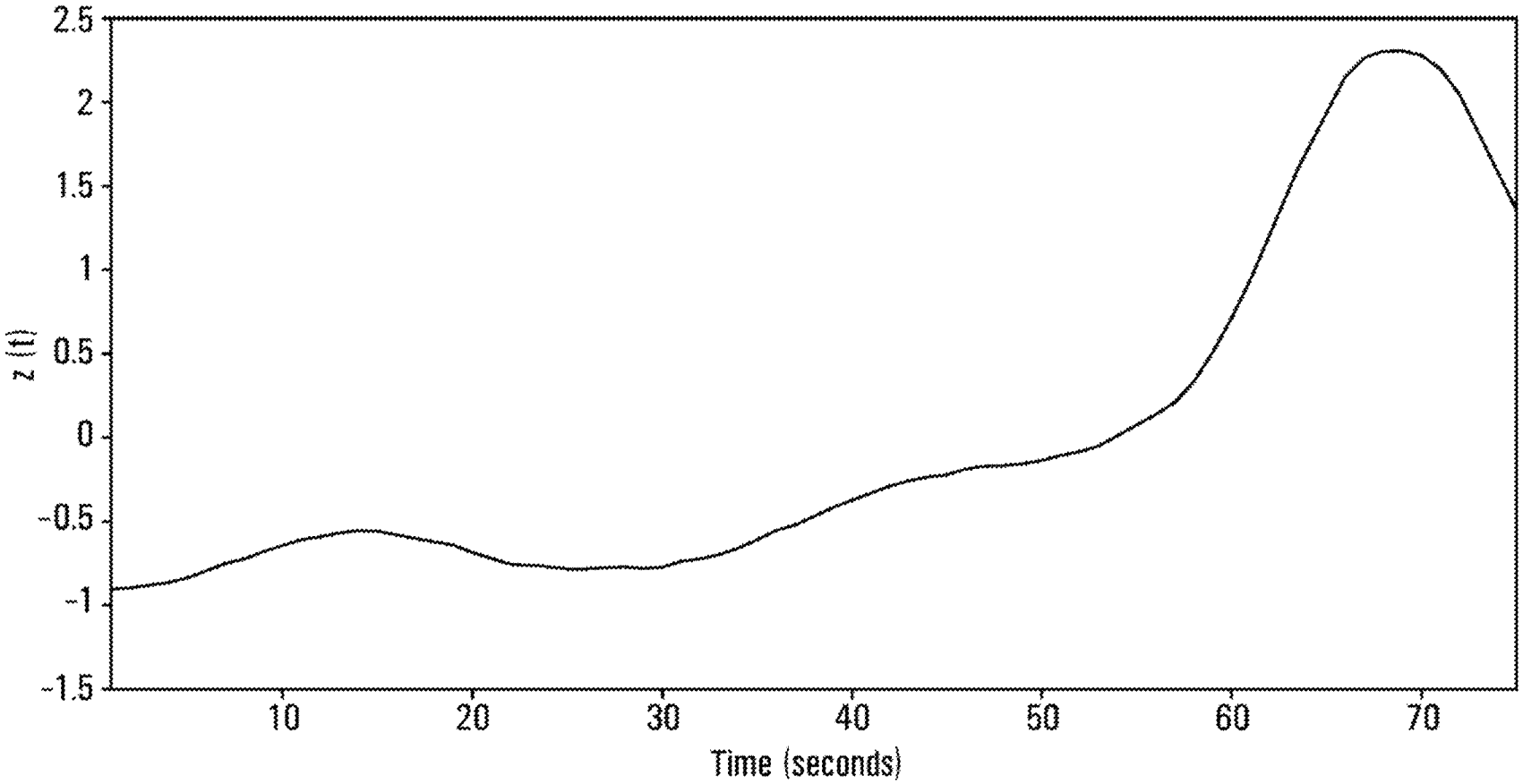
FIG. 12B shows a z-transformation of the differenced and averaged differential pressure of FIG. 12A, according to embodiments of the disclosure.
Figure 12C:
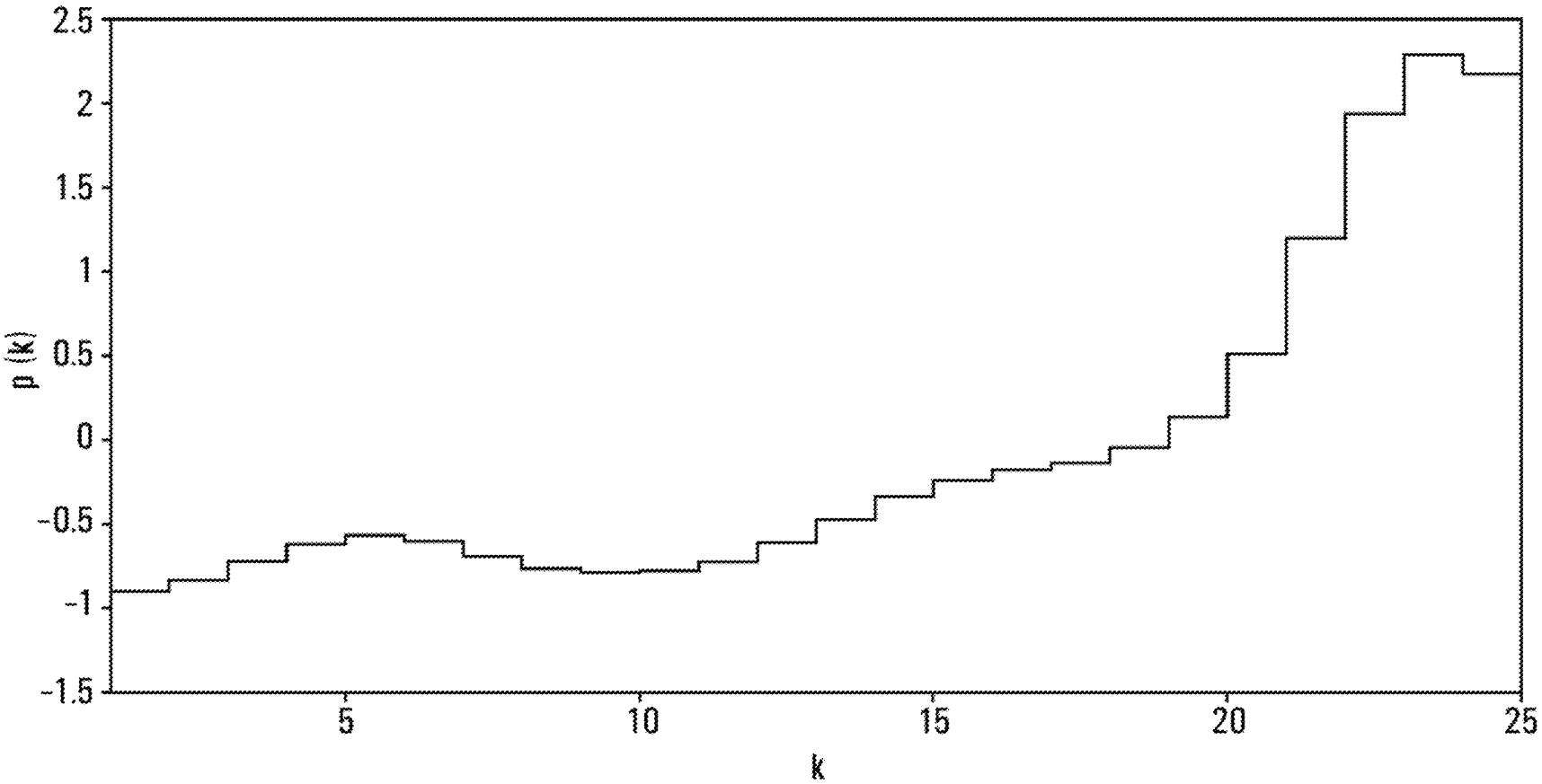
FIG. 12C shows a Piecewise Aggregate Approximation (PAA) of the z-transformation of FIG. 12B, according to embodiments of the disclosure.
Figure 12D:
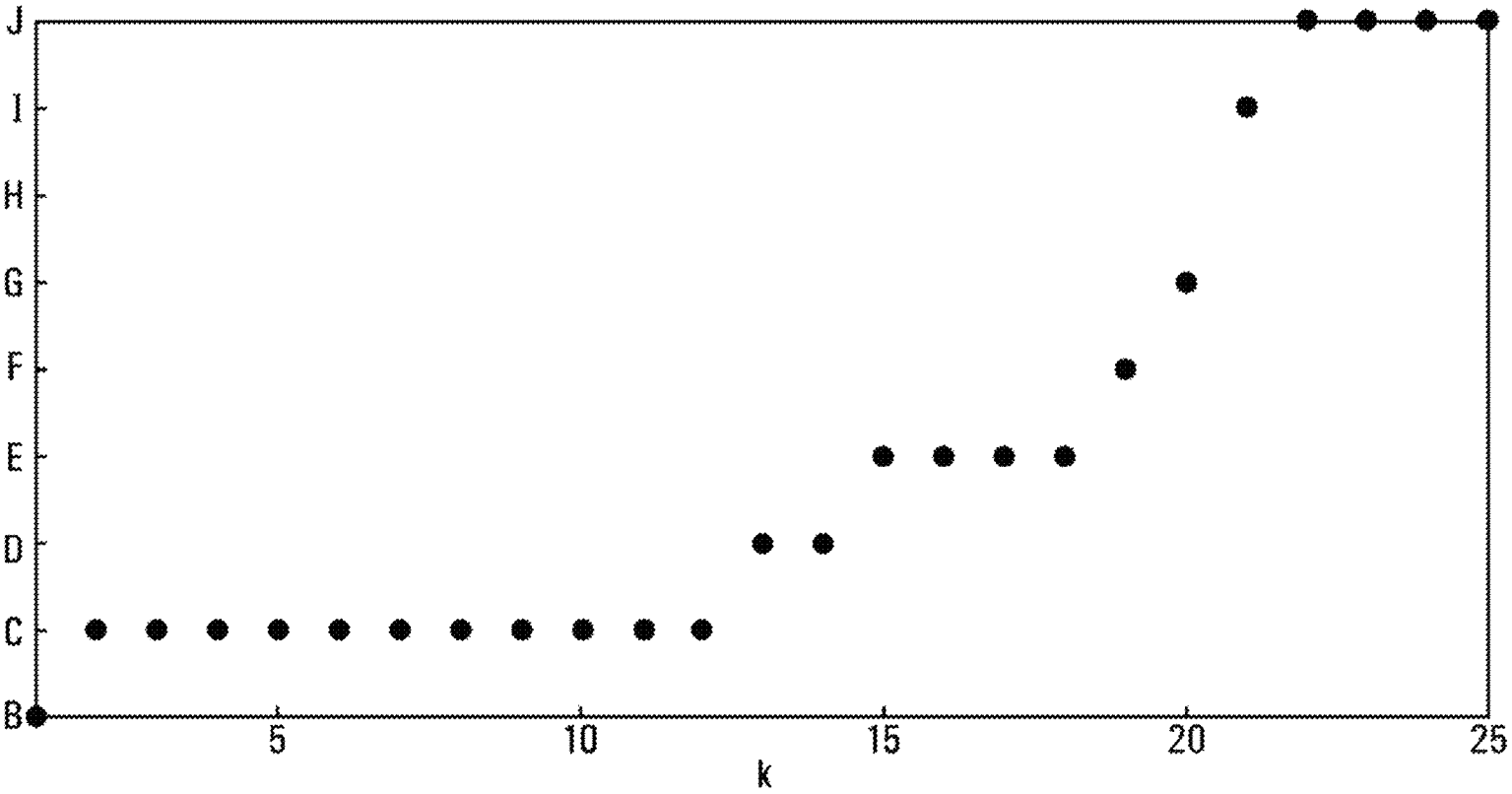
FIG. 12D shows a Symbolic Aggregate Approximation (SAX) of the PAA of FIG. 12C, according to embodiments of the disclosure.

FIG. 12D shows a SAX representation s(k)∈Γ of p(k). The transformations leading to the SAX representation are shown in FIGS. 12A-C. For an alphabet size γ=10, the original time series x(t) is converted to the word "BCCCCCCCCCCCDDEEEEFGIJJJJ".

For two time series $x_1(t)$ and $x_2(t)$ and their respective SAX representations, $S_1=\{s_1(k)\}_{k=1}^{k=\omega}$ and $S_2=\{s_2(k)\}_{k=1}^{k=\omega}$, where $s_i(k)\in\Gamma$ are the symbolic representations with symbols (letters) in alphabet $\Gamma$ with cardinality $\gamma$ and word length $\omega$, the minimum distance function between $S_1$ and $S_2$ is given by:

$$MINDIST = \sqrt{\frac{n}{\omega}}\sqrt{\sum_{k=1}^{\omega}(d(s_1(k), s_2(k)))^2}$$

where d(a,b) is the distance between two SAX symbols a and b. The distance d(•,•) can be obtained from a look-up table which is based on the breakpoints described above. The value v for each (i,j) entry in the table is given by:

$$v(i, j) = \begin{cases} 0, & |i-j| \le 1; \\ b_{max(i,j)-1} - b_{min(i,j)-1}, & \text{otherwise} \end{cases}$$

The recognition of a stall is reduced to comparing the distances $d_i\in R$ between the SAX representations $s_i(k)$ of each drilling parameter $x_i(t)$ and to their respective archetype patterns $a_i(k)$. If all distance thresholds $\lambda_i$ are satisfied, then the set of patterns in the drilling parameters are recognized as a stall (i.e. the potential mud motor stall is validated as a mud motor stall). That is:

$$\mathbb{I}_{stall} = \begin{cases} 1, & d_i(s_i, a_i) < \lambda_i \forall\ i = 1, \ldots, n; \\ 0, & \text{otherwise} \end{cases}$$

Figure 13:
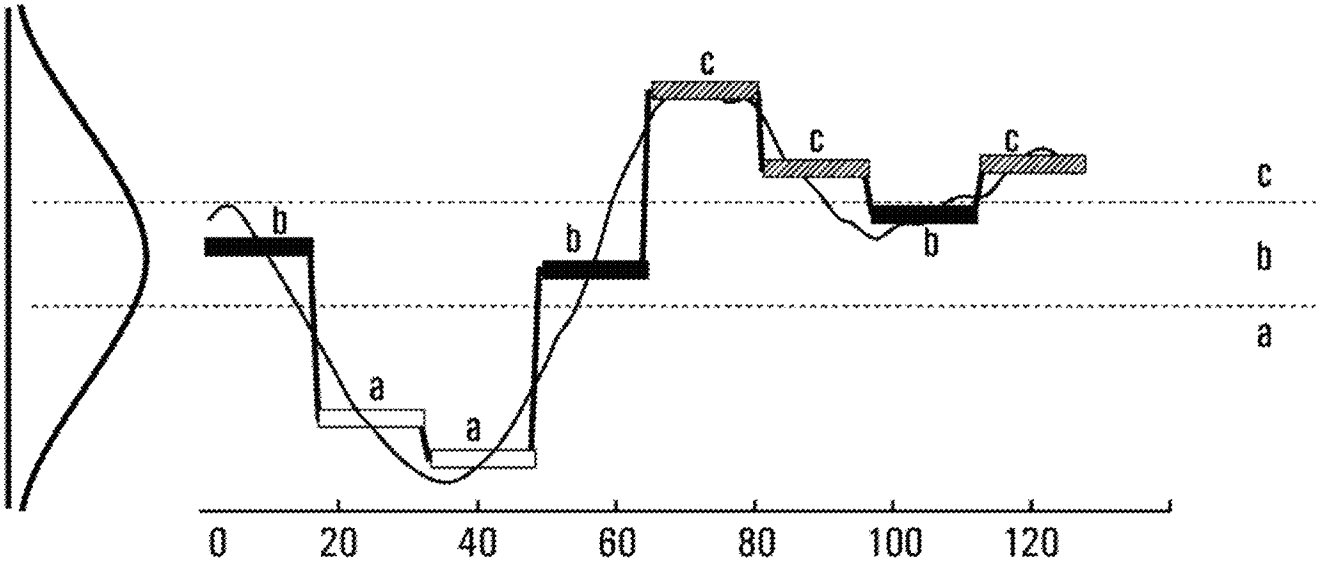
FIG. 13 shows an example time series of a signal, a PAA of the signal, and a SAX of the signal, according to embodiments of the disclosure.

FIG. 13 shows the original time series, the PAA approximation, and the SAX symbols.

FIG. 14 shows a look-up table with breakpoints $\beta_i$ and a the number of symbols.

FIGS. 15A-C show (A) Euclidean distance, (b) SAX distance, and (C) SAX minimum distance between symbols calculated using equation (25).

Example Training and Validation

This section is based on the SAX representation of the time series discussed above. Specifically, in terms of identifying mud motor stalls from drilling parameter time series data, a set of patterns is compared to archetype patterns corresponding to mud motor stall events. The similarity between the sequences and the archetype patterns is measured by the distance between the candidate sequences and their respective archetypes.

A set of 100 examples of stall events and their time series for DIFFP, torque, WOB, and ROP were collected and divided into a set of 50 training examples and 50 validation examples. The PAA representation of the training data set is shown in FIG. 16.

Figure 16:
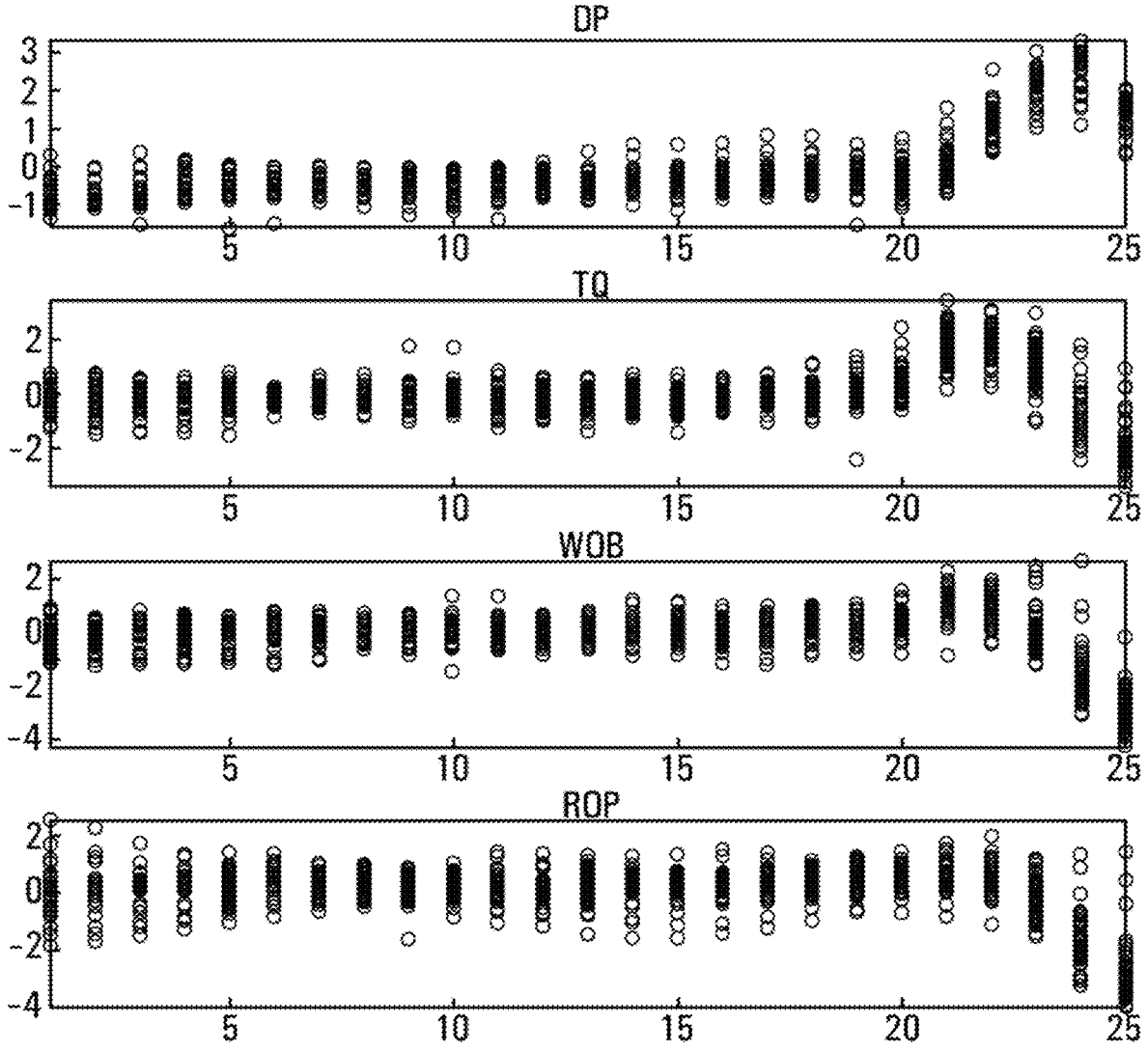
FIG. 16 shows PAA representations of 50 training data sets, according to embodiments of the disclosure.

Using the SAX transform, the distance between each of the series in FIG. 16 was computed using the distance measure in equation (25). The heat map of the distances is shown in FIG. 17.

Figure 17:
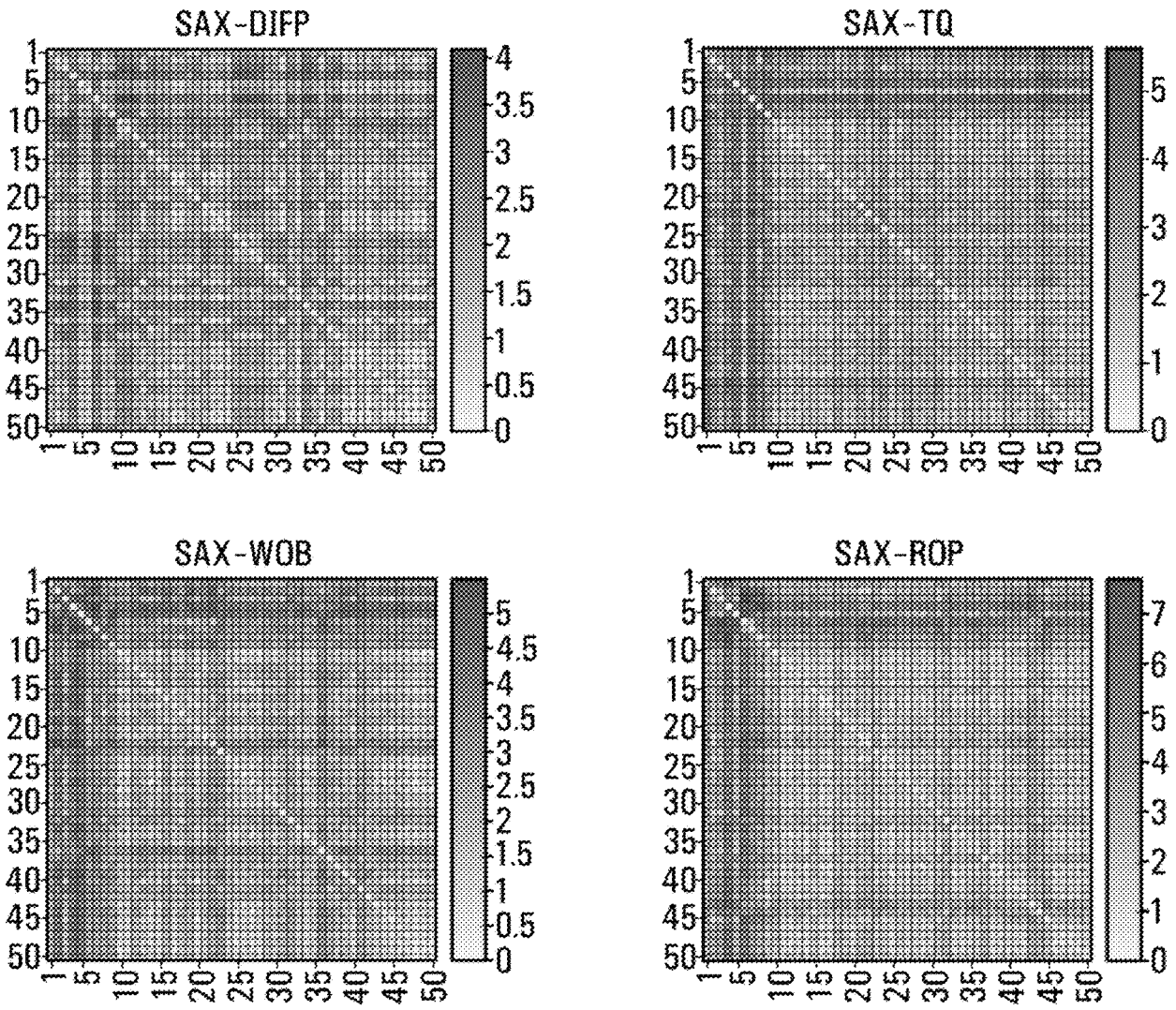
FIG. 17 shows SAX distances between the 50 training data sets, according to embodiments of the disclosure.

The collection of SAX distances shown in FIG. 17 was used to determine the threshold archetype patterns and distances. That is, we wish to find the pattern that matches all of the other patterns in terms of its distance. This pattern is the archetype pattern (or set of patterns) and the maximum distance in this subset is the archetype threshold. For each variable, we are looking for a $\lambda$ that satisfies:

$$\min_{\lambda} D(S_i, S_j) < \lambda \quad \forall \quad i, j \in n$$

Figure 18:
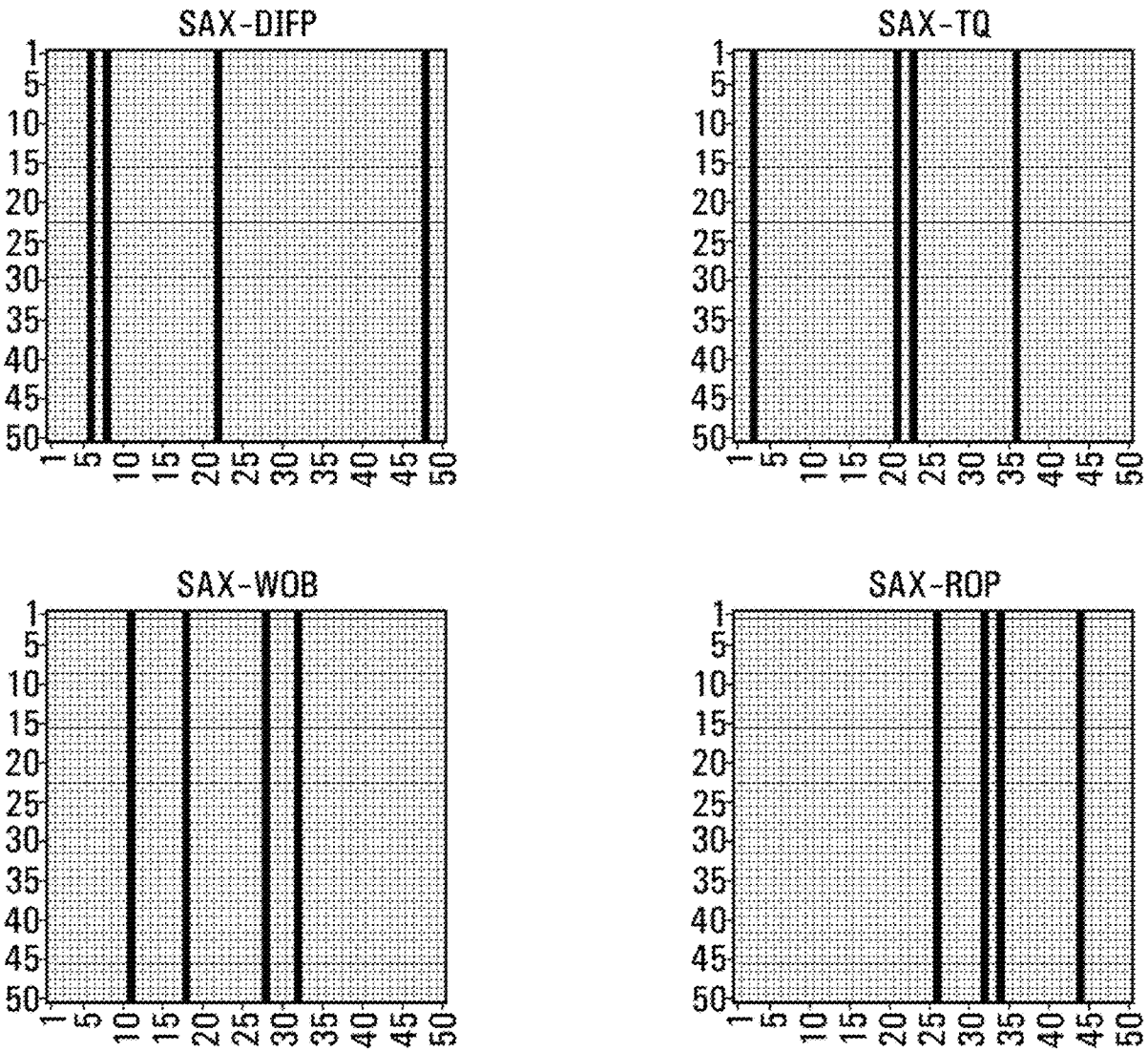
FIG. 18 shows SAX distances satisfying difference distance thresholds, according to embodiments of the disclosure.

A dynamic programming routine can be implemented to search for the distances for each variable. For example, FIG. 18 shows the five patterns that match all of the other patterns for each of the variables using the distance thresholds $\lambda_{DIFFP}$=2.18, $\lambda_{TQ}$=3.81, $\Delta_{WOB}$=3.502170755403, and $\lambda_{ROP}$=4.66.

Figure 19:
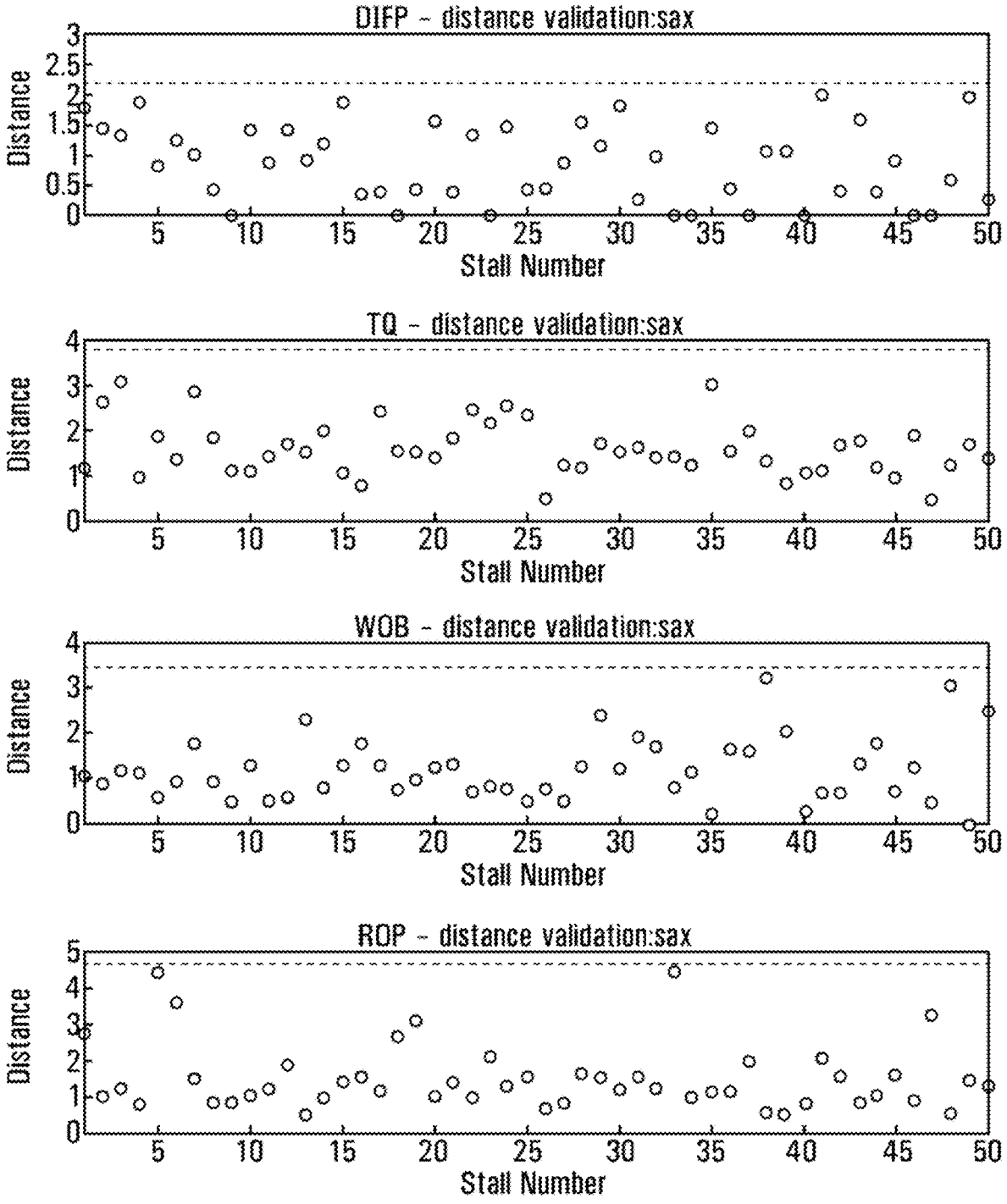
FIG. 19 shows SAX distances (dots) of signals, for each data set of 50 validation data sets, from an archetype pattern, and relative to an archetype threshold, according to embodiments of the disclosure.

To verify the archetype pattern and threshold for each variable $x_i$, the validation data set is used. Once again, performing the scaling, normalization, and transform procedure, the SAX representation of each set of parameters in the validation data set is determined, and the distance between these and the archetype pattern for each variable is calculated and compared to the archetype threshold. The comparison is shown in FIG. 19.

Figure 20:
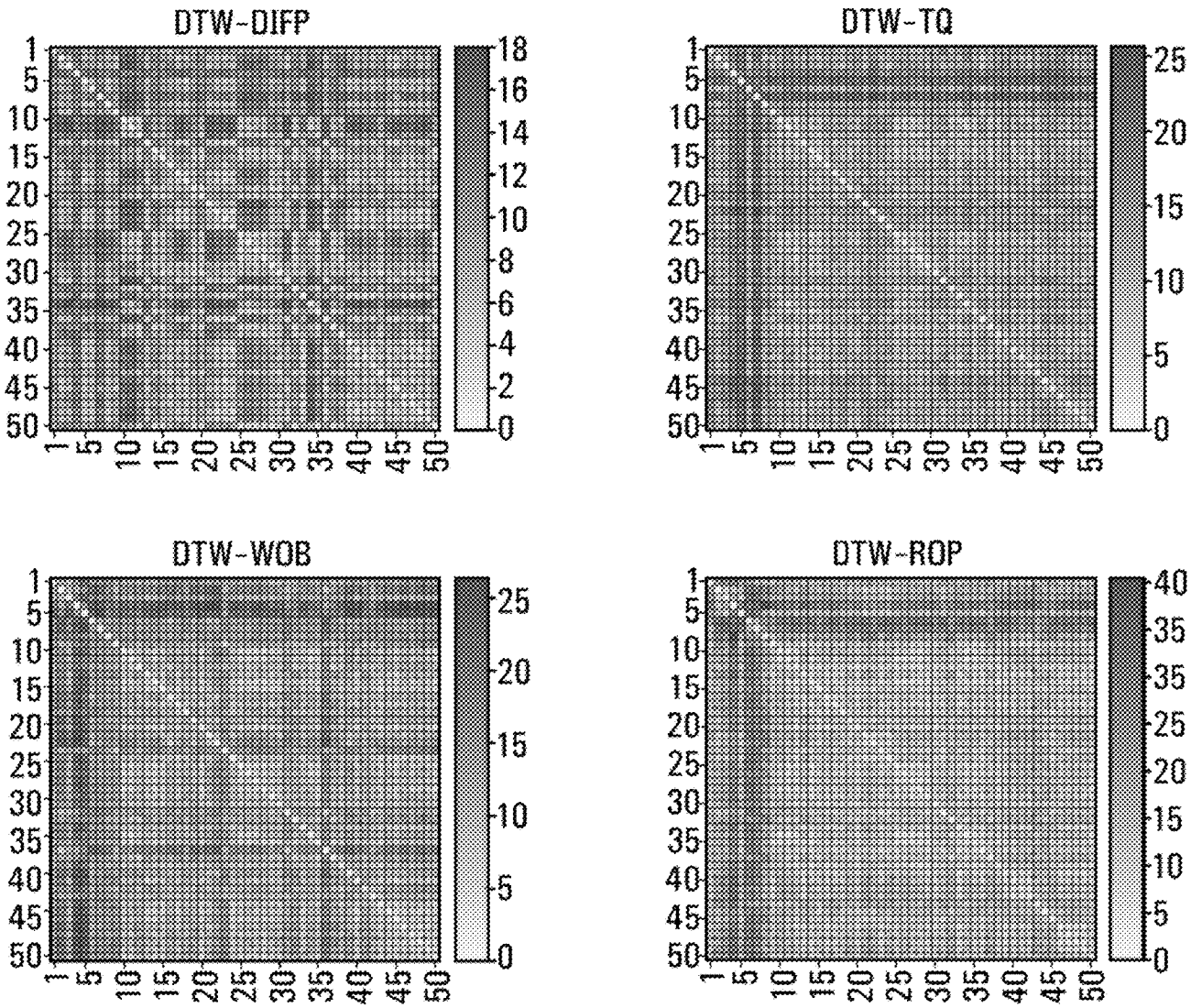
FIG. 20 shows Dynamic Time Warping distances between the 50 training data sets, according to embodiments of the disclosure.
Figure 21:
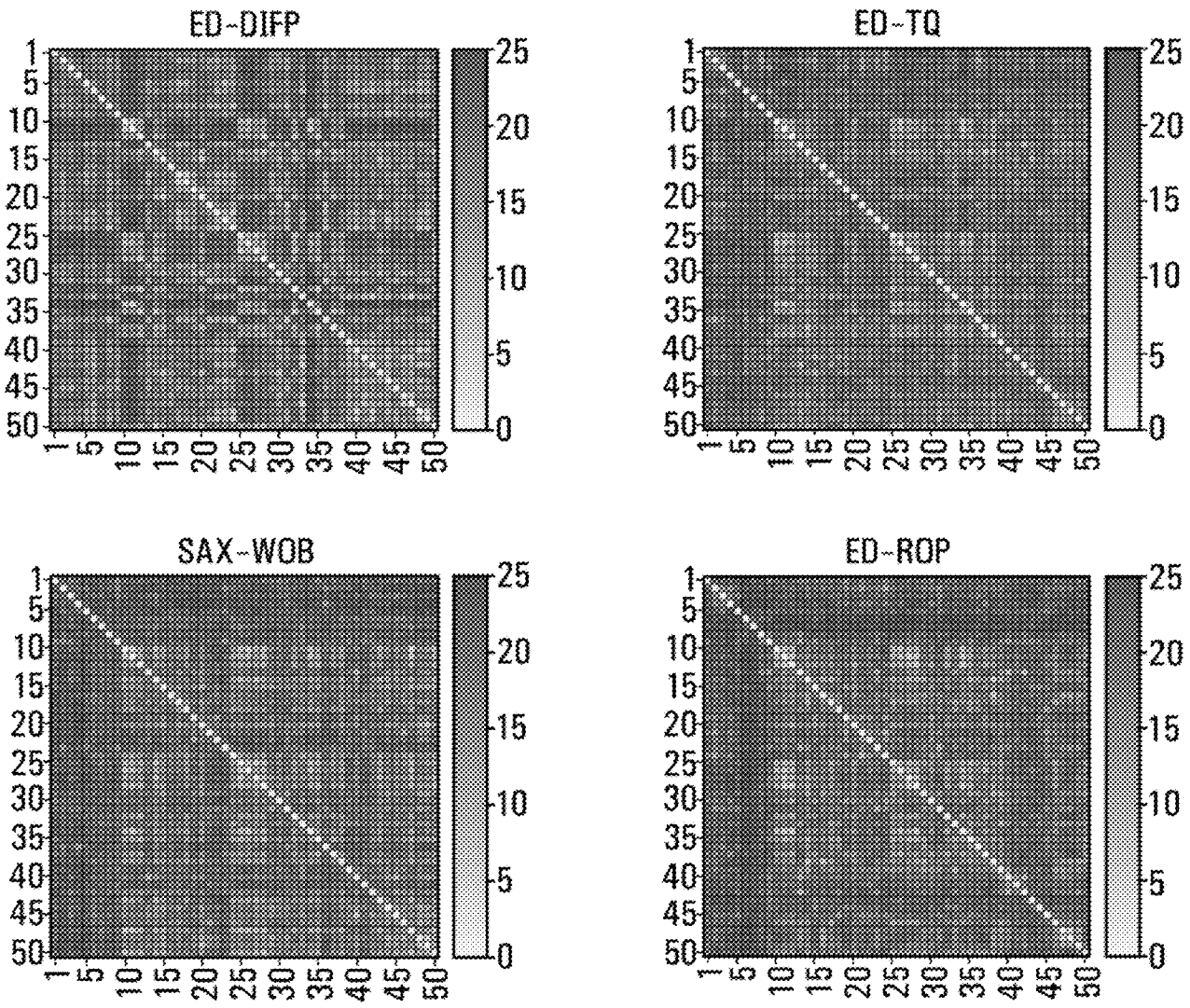
FIG. 21 shows Edit Distance distances between the 50 training data sets, according to embodiments of the disclosure.

The same procedure for determining the archetype patterns and distances can be applied, without loss of generality, using the DTW distance measure (see FIG. 20). Moreover, other distance measures that use different representations of the signal are also possible, such as Edit Distance (see FIG. 21), for example as described in "*Time Warp Edit Distances with Stiffness Adjustment for Time Series Matching*", Marteau, P. F., IEEE Transactions on Pattern Analysis and Machine Intelligence, IEEE Computer Society Digital Library, IEEE Computer Society, pp: 1-15, 3 Apr. 2008, and "*On the marriage of Lp-norm and edit distance*", L. Chen and R. Ng, In Proc. 30th International Conference on Very Large Data Bases, pp 792-801, 2004, the contents of which are hereby incorporated by reference in their entireties.

Motor Stall Alerts

Multiple alerts may be generated throughout the stall detection process. For example, an alert may be triggered in response to detecting a potential mud motor stall, i.e. the rate of change of a drilling parameter exceeds a threshold prescribed in equation (5). A further alert may be triggered if the potential mud motor stall is confirmed to be a mud motor stall, i.e. pattern recognition is confirmed.

Furthermore, stall severity metrics may calculated throughout the stall detection process. Metrics are intended to enable the user to decide if the stall is severe enough to interrupt normal operation of the rig and initiate restart procedures where manual intervention is required to manage drilling parameters, e.g. pump rate, outside control of the computer system.

If a motor stall has occurred, appropriate action should be taken to mitigate potential damaging effects. For example, shutting down pumps will stop circulation through the stalled motor and may prevent excessive wear to the elastomer in the motor power section. A general procedure for managing a mud motor stall is:

- Immediately stop drill string rotation.
- Reduce/stop flow through the motor by reducing mud pump rate or shutting down the pumps.
- Slowly release torque through the rotary system.
- Lift the drill string and bit off bottom.
- Proceed with a standard start-up procedure used after a connection.

Figure 22:
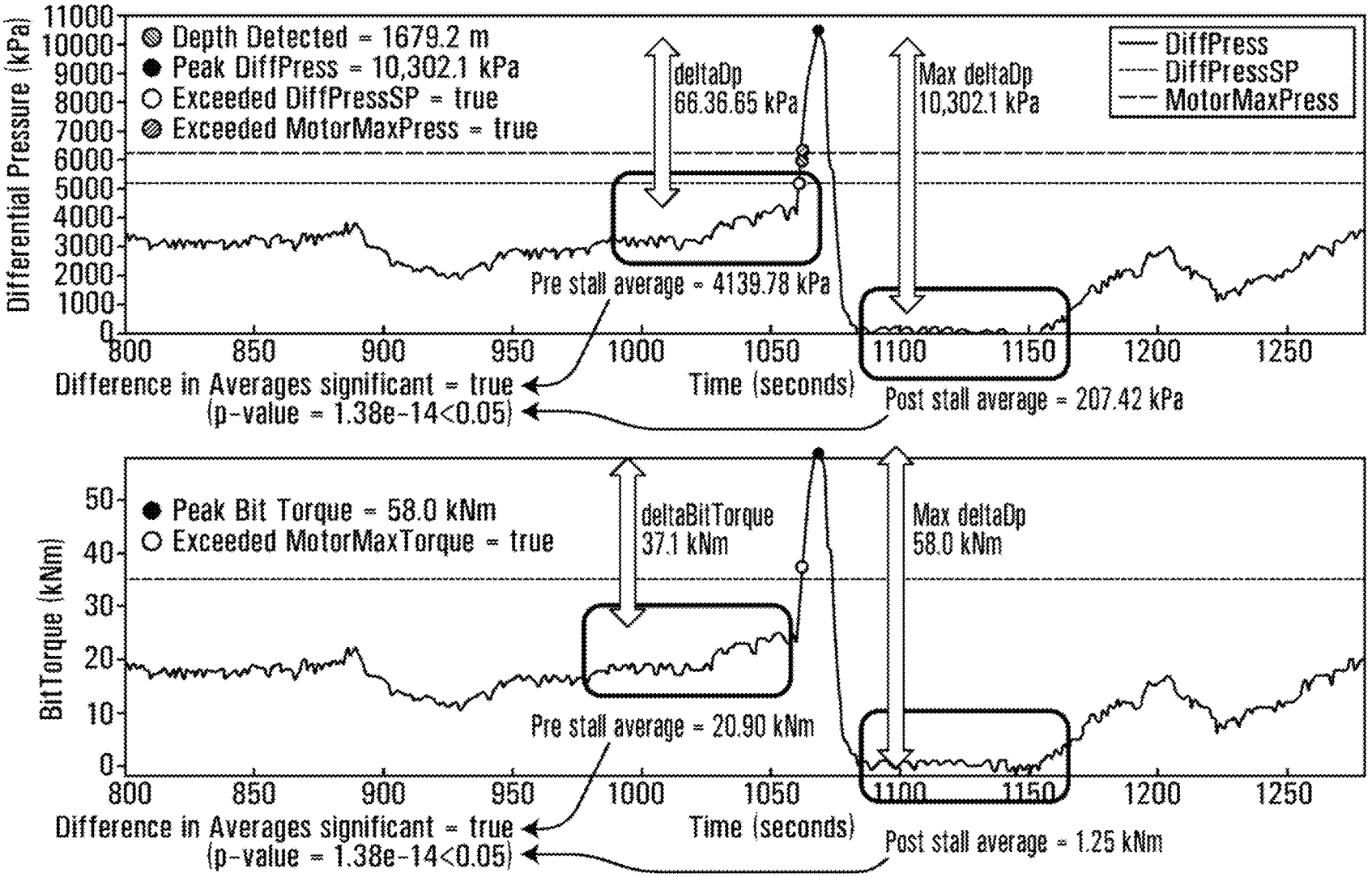
FIG. 22 shows examples motor stall metrics being displayed, according to embodiments of the disclosure.

The metrics are calculated to assess the severity of the stall by checking relevant drilling parameters against equipment tolerances, for example differential pressure vs. a maximum differential pressure of the mud motor, and relative changes throughout the stall process. The metrics may be displayed to the user in the alerts, and may be stored by stall detector 320 for analysis. FIG. 22 shows an example of metrics that are calculated following a stall.

Stall Mitigation

Motor stalls can cause damage to downhole equipment, causing temporary impairment of the drilling process and, in severe cases, requiring complete stoppage, tripping out of the hole, and replacement of the damaged motor. Recurring stalls can be symptomatic of damage, for example to the motor stator materials, which may result in loss of power and lower drilling rates. In other cases, changes in drilling parameters may be made in order to resume normal operation. The process of identifying, quantifying, and taking corrective action when a stall or series of stalls occurs can be challenging because it may require immediate action followed by prolonged and continual monitoring and diagnostic of the drilling process, and finally corrective action to mitigate the onset of subsequent stalls.

Stall detector 320 may implement one or more of the following functions in order to automatically mitigate potential future stalls. In particular, stall detector 320 may identify abnormal fluctuations in drilling parameters, including differential pressure, standpipe pressure, rotary torque, bit torque, rotary RPM, bit RPM, weight on bit, and rate of penetration. Stall detector 320 may furthermore determine maximum and minimum readings of the drilling parameters, differences between the maximum and minimum readings of the drilling parameters, and rates of change of the drilling parameters, during the stall. These values may be compared to various operational thresholds, such as for example a maximum motor differential pressure, a maximum motor torque, and a maximum standpipe pressure. Such comparisons may enable stall detector 320 to determine the relative severity of a given stall event. Stall detector 320 may compare and identify relationships between severity estimates with specific drilling parameter settings before and after a stall, compare and identify relationships between severity estimates with trends in drilling parameter settings for sequential stall events, and may compare and identify relationships between trends in severity estimates and drilling parameter settings for sequential stall events Based on the above comparisons, stall detector 320 may provide recommendations (e.g. on a display and/or via an audio output) for adjustments to drilling parameter setpoints. Alternatively, or in addition, stall detector 320 may actively adjust drilling parameter setpoints, for example by setting drilling parameter setpoints based on drilling parameter values that are associated with, or predicted to be associated with, the absence of stall events.

The automated management process may continue to change the drilling parameter setpoints until motor stalls are no longer detected. The changes may be temporary such that the drilling parameter setpoints are returned (instantly or gradually) to their original values after a fixed amount of time. In other cases, the changes in drilling parameter settings may be permanent until returned to their original or other prescribed settings, based on the discretion of the drilling process operator.

In addition to the stall detector being operable to detect stalls during a drilling operation, historical drilling parameter data may be inputted to the stall detector for performing post-well analysis.

While stall detector 320 has been described in the context of FIG. 3 as receiving measured drilling parameters from doghouse computer 210, this is representative of only an example embodiment of the disclosure, and, according to other embodiments, stall detector 320 may receive measured drilling parameters directly from UJB 2 or rig sensors 202. Accordingly, a stall detector as described herein should be construed broadly as encompassing any suitable apparatus operable to detect potential mud motor stalls, and validate detected mud motor stalls, according to any of the methods described herein.

While the disclosure has been described in connection with specific embodiments, it is to be understood that the disclosure is not limited to these embodiments, and that alterations, modifications, and variations of these embodiments may be carried out by the skilled person without departing from the scope of the disclosure.

It is furthermore contemplated that any part of any aspect or embodiment discussed in this specification can be implemented or combined with any part of any other aspect or embodiment discussed in this specification.

The invention claimed is:

1. A method of detecting a mud motor stall during a drilling operation, comprising:

using one or more drilling sensors to obtain real-time drilling parameter data during the drilling operation;

using one or more stall detectors to perform a first stall detection operation comprising:

determining, based on the real-time drilling parameter data, that a potential mud motor stall has occurred, wherein the potential mud motor stall is associated with at least some of the real-time drilling parameter data;

in response to determining that the potential mud motor stall has occurred, using the one or more stall detectors to perform a second stall detection operation comprising:

generating, based on the real-time drilling parameter data associated with the potential mud motor stall, one or more signatures of the potential mud motor stall;

comparing the one or more signatures to one or more stored signatures associated with one or more mud motor stalls; and based on the comparison, determining that the potential mud motor stall is a mud motor stall; and in response to the determining that the potential mud motor stall is a mud motor stall, adjusting one or more drilling parameter setpoints associated with one or more drilling parameters;

wherein the comparing the one or more signatures to the one or more stored signatures comprises comparing the one or more signatures of the potential mud motor stall to one or more stored signatures of the one or more mud motor stalls, wherein the one or more stored signatures are generated from the mud motor stall data; and wherein the comparing the one or more signatures of the potential mud motor stall to the one or more stored signatures of the one or more mud motor stalls comprises using symbolic aggregate approximation analysis to determine one or more distances between the one or more signatures of the potential mud motor stall and the one or more stored signatures of the one or more mud motor stalls.

2. The method of claim 1, wherein determining that the potential mud motor stall has occurred comprises:

determining, based on the drilling parameter data, a rate of change of one or more drilling parameters;

comparing the rate of change of the one or more drilling parameters to a threshold rate of change; and based on the comparison of the rate of change of the one or more drilling parameters to the threshold rate of change, determining that the potential mud motor stall has occurred.

3. The method of claim 1, wherein generating the one or more signatures comprises:

filtering processed measurements of one or more drilling parameters by:

identifying change points in the processed measurements; and eliminating the processed measurements lying outside of a range defined by the change points; and using the filtered processed measurements to generate the one or more signatures.

4. The method of claim 1, further comprising, before adjusting the one or more drilling parameter setpoints, determining a severity of the mud motor stall based on one or more of:

one or more of minimum and maximum values of the one or more drilling parameters during the mud motor stall;

a rate of change of the one or more drilling parameters during the mud motor stall; and an amount by which one or more operational thresholds of a mud motor were exceeded during the mud motor stall, wherein the adjusting is based on the determined severity of the mud motor stall.

5. The method of claim 1, further comprising generating a notification or initiating an alarm in response to one or more of:

determining that the potential mud motor stall has occurred; and determining that the potential mud motor stall is a mud motor stall.

6. A system for detecting a mud motor stall during a drilling operation, comprising:

one or more stall detectors comprising one or more processors configured to receive as inputs real-time measurements of one or more drilling parameters during the drilling operation, wherein the one or more stall detectors are configured to:

perform a first stall detection operation comprising:

generating real-time drilling parameter data from the real-time measurements of the one or more drilling parameters; and determining, based on the real-time drilling parameter data, that a potential mud motor stall has occurred, wherein the potential mud motor stall is associated with at least some of the real-time drilling parameter data;

in response to determining that the potential mud motor stall has occurred, perform a second stall detection operation comprising:

generating, based on the real-time drilling parameter data associated with the potential mud motor stall, one or more signatures of the potential mud motor stall;

comparing the one or more signatures to one or more stored signatures associated with one or more mud motor stalls; and based on the comparison, determining whether the potential mud motor stall is a mud motor stall; and if the potential mud motor stall is determined to be a mud motor stall, adjust one or more drilling parameter setpoints associated with the one or more drilling parameters;

wherein the comparing the one or more signatures to the one or more stored signatures comprises comparing the one or more signatures of the potential mud motor stall to one or more stored signatures of the one or more mud motor stalls, wherein the one or more stored signatures are generated from the mud motor stall data; and wherein the comparing the one or more signatures of the potential mud motor stall to the one or more stored signatures of the one or more mud motor stalls comprises using symbolic aggregate approximation analysis to determine one or more distances between the one or more signatures of the potential mud motor stall and the one or more stored signatures of the one or more mud motor stalls.

7. The system of claim 6, wherein determining that the potential mud motor stall has occurred comprises:

determining, based on the drilling parameter data, a rate of change of the one or more drilling parameters;

comparing the rate of change of the one or more drilling parameters to a threshold rate of change; and based on the comparison of the rate of change of the one or more drilling parameters to the threshold rate of change, determining that the potential mud motor stall has occurred.

8. The system of claim 6, wherein generating the one or more signatures comprises:

processing the measurements of the one or more drilling parameters;

filtering the processed measurements of the one or more drilling parameters by:

identifying change points in the processed measurements; and eliminating the processed measurements lying outside of a range defined by the change points; and using the filtered processed measurements to generate the one or more signatures.

9. The system of claim 6, wherein the one or more stall detectors are further configured to generate a notification or initiate an alarm in response to one or more of:

determining that the potential mud motor stall has occurred; and determining that the potential mud motor stall is a mud motor stall.

10. A computer-readable medium having stored thereon computer program code configured when executed by one or more processors to cause the one or more processors to perform a method for detecting a mud motor stall during a drilling operation, comprising:

performing a first stall detection operation comprising:

obtaining real-time drilling parameter data during the drilling operation;

determining, based on the real-time drilling parameter data, that a potential mud motor stall has occurred, wherein the potential mud motor stall is associated with at least some of the real-time drilling parameter data;

in response to determining that the potential mud motor stall has occurred, performing a second stall detection operation comprising:

generating, based on the real-time drilling parameter data associated with the potential mud motor stall, one or more signatures of the potential mud motor stall;

comparing the one or more signatures to stored signatures associated with one or more mud motor stalls; and based on the comparison, determining whether the potential mud motor stall is a mud motor stall; and if the potential mud motor stall is determined to be a mud motor stall, adjusting one or more drilling parameter setpoints associated with one or more drilling parameters;

wherein the comparing the one or more signatures to the one or more stored signatures comprises comparing the one or more signatures of the potential mud motor stall to one or more stored signatures of the one or more mud motor stalls, wherein the one or more stored signatures are generated from the mud motor stall data; and wherein the comparing the one or more signatures of the potential mud motor stall to the one or more stored signatures of the one or more mud motor stalls comprises using symbolic aggregate approximation analysis to determine one or more distances between the one or more signatures of the potential mud motor stall and the one or more stored signatures of the one or more mud motor stalls.

11. The computer-readable medium of claim 10, wherein determining that the potential mud motor stall has occurred comprises:

determining, based on the drilling parameter data, a rate of change of one or more drilling parameters;

comparing the rate of change of the one or more drilling parameters to a threshold rate of change; and based on the comparison of the rate of change of the one or more drilling parameters to the threshold rate of change, determining that the potential mud motor stall has occurred.

12. The computer-readable medium of claim 10, wherein generating the one or more signatures comprises:

filtering processed measurements of one or more drilling parameters by:

identifying change points in the processed measurements; and eliminating the processed measurements lying outside of a range defined by the change points; and using the filtered processed measurements to generate the one or more signatures.

13. The computer-readable medium of claim 10, wherein the method further comprises generating a notification or initiating an alarm in response to one or more of:

determining that the potential mud motor stall has occurred; and determining that the potential mud motor stall is a mud motor stall.

14. A drilling rig comprising:

a drill string having a mud motor at an end of the drill string;

sensors for measuring drilling parameters; and one or more stall detectors comprising one or more processors configured to receive as inputs real-time measurements of the one or more drillings parameters obtained by the sensors during a drilling operation, and configured to:

perform a first stall detection operation comprising:

generating real-time drilling parameter data from the real-time measurements of the one or more drilling parameters; and determining, based on the real-time drilling parameter data, that a potential mud motor stall has occurred at the mud motor, wherein the potential mud motor stall is associated with at least some of the real-time drilling parameter data;

in response to determining that the potential mud motor stall has occurred, perform a second stall detection operation comprising:

generating potential mud motor stall data based on the drilling parameter data;

generating, based on the real-time drilling parameter data associated with the potential mud motor stall, one or more signatures of the potential mud motor stall;

comparing the one or more signatures of the potential mud motor stall to one or more stored signatures of one or more mud motor stalls; and based on the comparison, determining whether the potential mud motor stall is a mud motor stall; and if the potential mud motor stall is determined to be a mud motor stall, adjust one or more drilling parameter setpoints associated with the one or more drilling parameters;

wherein the comparing the one or more signatures of the potential mud motor stall to the one or more stored signatures comprises comparing the one or more signatures of the potential mud motor stall to one or more stored signatures of the one or more mud motor stalls, wherein the one or more stored signatures are generated from the mud motor stall data; and wherein the comparing the one or more signatures of the potential mud motor stall to the one or more stored signatures of the one or more mud motor stalls comprises using symbolic aggregate approximation analysis to determine one or more distances between the one or more signatures of the potential mud motor stall and the one or more stored signatures of the one or more mud motor stalls.

* * * * *